US005492800A

United States Patent [19]

Yamagami

[11] Patent Number: 5,492,800

[45] Date of Patent: Feb. 20, 1996

[54] SILVER HALIDE PHOTOGRAPHIC LIGHT-SENSITIVE MATERIAL

[75] Inventor: Hiroyuki Yamagami, Minami-ashigara, Japan

[73] Assignee: Fuji Photo Film Co., Ltd., Kanagawa, Japan

[21] Appl. No.: 253,577

[22] Filed: Jun. 3, 1994

Related U.S. Application Data

[63] Continuation of Ser. No. 945,620, Sep. 16, 1992, abandoned.

[30] Foreign Application Priority Data

Sep. 18, 1991 [JP] Japan ..... 3-265536

[51] Int. Cl.[6] ..... G03C 1/035; G03C 1/04

[52] U.S. Cl. ..... 430/567; 430/588; 430/609; 430/627; 430/630; 430/634

[58] Field of Search ..... 430/551, 567, 430/588, 609, 630, 634, 627

[56] References Cited

U.S. PATENT DOCUMENTS

| | | | |
|---|---|---|---|
| 3,165,495 | 1/1965 | Taylor | 430/609 |
| 3,770,450 | 11/1973 | Kawano et al. | 430/630 |
| 4,397,943 | 8/1983 | Ishiguro et al. | 430/609 |
| 4,806,461 | 2/1989 | Ikeda et al. | 430/567 |
| 4,891,306 | 1/1990 | Tokoyama et al. | 430/634 |
| 5,068,173 | 11/1991 | Takehara et al. | 430/567 |
| 5,298,383 | 3/1994 | Mihayashi et al. | 430/567 |

FOREIGN PATENT DOCUMENTS

| | | | |
|---|---|---|---|
| 349286 | 1/1990 | European Pat. Off. | 430/567 |

OTHER PUBLICATIONS

James, T. H., ed., The Theory of the Photographic Process, 4th Ed., Macmillan, 1977, p. 20.

*Primary Examiner*—Janet C. Baxter

*Attorney, Agent, or Firm*—Birch, Stewart, Kolasch & Birch

[57] ABSTRACT

A silver halide photographic light-sensitive material has at least one silver halide emulsion layer. 50% or more of a total projected area of silver halide grains of at least one silver halide emulsion in the silver halide emulsion layer are accounted for by tabular grains each having an average aspect ratio of 2 or more and containing dislocations. At least one layer of the light-sensitive material contains at least one sensitizing dye represented by Formula (A), (B), or (C) below, and at least one layer of the light-sensitive material contains a polymer containing a repeating unit represented by Formula (I) or (II) below:

Formula (A)

Formula (B)

Formula (C)

Formula (I)

Formula (II)

16 Claims, 2 Drawing Sheets

SILVER HALIDE PHOTOGRAPHIC LIGHT-SENSITIVE MATERIAL

This application is a continuation, of application serial No. 07/945,620 filed on Sep. 16, 1992, now abandoned.

BACKGROUND OF THE INVENTION

1. Field of the Invention

The present invention relates to a silver halide photographic light-sensitive material and, more particularly, a photographic light-sensitive material having a high sensitivity, a high resistance to pressure, and a good desilvering property.

2. Description of the Related Art

Basic properties required for silver halide emulsions for photography are a high sensitivity, a low fog, and a fine graininess.

As a technique for satisfying the above requirements, the use of tabular silver halide grains including dislocation lines is known in recent years (JP-A-63-220238 ("JP-A" means Unexamined Published Japanese Patent Application)).

It is possible to obtain emulsions having a high sensitivity and a high resistance to pressure by using these tabular grains. However, in a system in which an amount of sensitizing dyes is increased to obtain light absorption as much as possible, a resistance to pressure and a desilvering property are significantly degraded.

Generally, various pressures are applied to a photographic light-sensitive material, coated with silver halide emulsions. For example, a photographic negative film for general purposes is taken up by a patrone, bent when loaded in a camera, or pulled upon winding up of a frame.

On the other hand, a sheet-like film such as a printing light-sensitive material or a direct medical roentgen light-sensitive material is often bent because it is directly handled by human hands.

In addition, all light-sensitive materials are subjected to a high pressure when cut or processed.

When various pressures are applied to a photographic light-sensitive material as described above, silver halide grains are pressurized via gelatin contained as a carrier (binder) for the silver halide grains or via a plastic film employed as a support. It is known that photographic properties of a photographic light-sensitive material are changed when pressure is applied to silver halide grains, as reported in detail in, e.g., K. B. Mather, J. Opt. Soc. Am., 38. 1054 (1948); P. Faelens and P. de Smet. Sci. et. Ind Phot., 25. No. 5. 178 (1954); and P. Faelens. J. Phot. Sci. 2. 105 (1954).

For this reason, a strong demand has arisen for a photographic light-sensitive material which can not be adversely affected in photographic properties even if it is subjected to these various pressures.

One of the conventionally known methods of improving resistance to pressure is to prevent pressure from reaching the silver halide grains, for example by adding a plasticizer such as a polymer or an emulsified product to a silver halide emulsion, or by decreasing the silver halide/gelatin ratio of the emulsion.

For example, British Patents 738,618, 738,637, and 738,639 disclose methods using a heterocyclic compound, alkylphthalate, and alkyl ester, respectively. U.S. Pat. Nos. 2,960,404 and 3,121,060 disclose methods using polyhydric alcohol and carboxyalkylcellulose, respectively. JP-A-49-5017 discloses a method using paraffine and carboxylate, and JP-B-53-28086 ("JP-B" means Examined Published Japanese Patent Application) discloses a method using alkylacrylate and an organic acid.

The method of adding a plasticizer, however, lowers the mechanical strength of the emulsion layers, and this imposes limitations on the use of the method. When the ratio of gelatin is increased, on the other hand, the development speed is decreased. Thus, it is difficult for any of these methods to achieve satisfactory effects.

In addition, the use of naphthoxazolocarbocyanine is described in, e.g., JP-B-61-80237, JP-A-60-108838, JP-A-61-8023, JP-A-63-291057, JP-A-61-32841, JP-A-60-225146, JP-A-60-128433, JP-A-60-128132, JP-A-59-185330, JP-A-59-149346, JP-A-59-116646, JP-A-59-78338, JP-A-63-214745 and JP-B-54-34609.

None of these patents disclose or suggest, however, that the effect of the present invention, which is described later, is achieved by a combination of naphthoxazolocarbocyanine represented by Formula (A), (B), or (C) shown hereinafter, an emulsion of a tabular silver halide having dislocations and a polymer compound having a repeating unit represented by Formula (I) or (II) shown hereinafter.

SUMMARY OF THE INVENTION

It is an object of the present invention to provide a photographic light-sensitive material having a high sensitivity, a high resistance to pressure, and a good desilvering property.

The present inventors have made extensive studies and achieved the object of the present invention by the following means. That is, the object of the present invention is achieved by a silver halide photographic light-sensitive material having at least one silver halide emulsion layer on a support, wherein 50% or more of a total projected area of silver halide grains of at least one silver halide emulsion contained in the silver halide emulsion layer are accounted for by tabular silver halide grains each having an aspect ratio of 2 or more and containing dislocations, at least one layer of the light-sensitive material contains at least one of sensitizing dyes represented by Formulas (A), (B) and (C) below, and at least one layer of the light-sensitive material contains a polymer having a repeating unit represented by Formula (I) or (II) below:

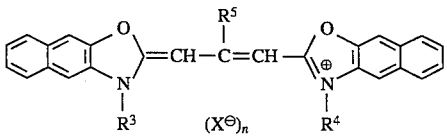

Formula (A)

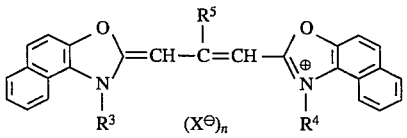

Formula (B)

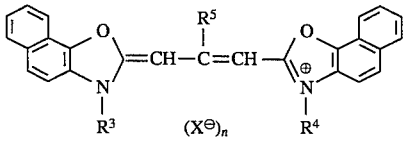

Formula (C)

wherein each of $R^3$ and $R^4$ represents an alkyl group, $R^5$ represents a hydrogen atom, an alkyl group, or an aryl group, $X^{\ominus}$ represents an anion, n represents a value for adjusting an electric charge of the whole molecule, and when an inner salt is to be formed, n=0:

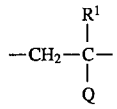

Formula (I)

wherein $R^1$ represents a hydrogen atom or an alkyl group, and Q is selected from the group consisting of Formulas 1) to 4) below:

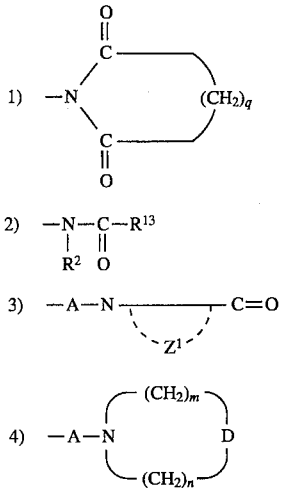

wherein in Formula 1), q represents an integer of 2 to 4, in Formula 2), each of $R^2$ and $R^{13}$ represents a hydrogen atom or an alkyl group, in Formula 3), $Z^1$ represents an atomic group required to form a lactam ring, an oxazolidone ring, or a pyridone ring, A represents a single bond, a —CO— group, or a —CO—B—$(CH_2)_j$— group wherein B represents an —O— group or an —$NR^4$— group (wherein $R^4$ represents a hydrogen atom or an alkyl group) and j represents an integer of 1 to 6, and in Formula 4), A has the same meaning as in Formula 3), D represents a single bond, an —O— group, or an $NR^7$— group, each of m and n represents an integer of 1 to 6 and satisfies a relation of m+n=4 to 7 wherein $R^7$ represents a hydrogen atom, an alkyl group, or a —CO—$R^6$ group (wherein $R^6$ represents an alkyl group); Formula (II)

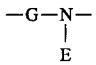

Formula (II)

wherein E represents —$COR_{21}$, —$COOR_{22}$, —$CONHR_{23}$, —$CONHCOR_{24}$, or —$SO_2R_{25}$ (wherein each of $R_{21}$, $R_{22}$, $R_{23}$, $R_{24}$, and $R_{25}$ represents a substituted or unsubstituted alkyl, aryl, or cycloalkyl group, or a hydrogen atom), and G represents an alkylene group having 2 to 5 carbon atoms.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

Figure 1:
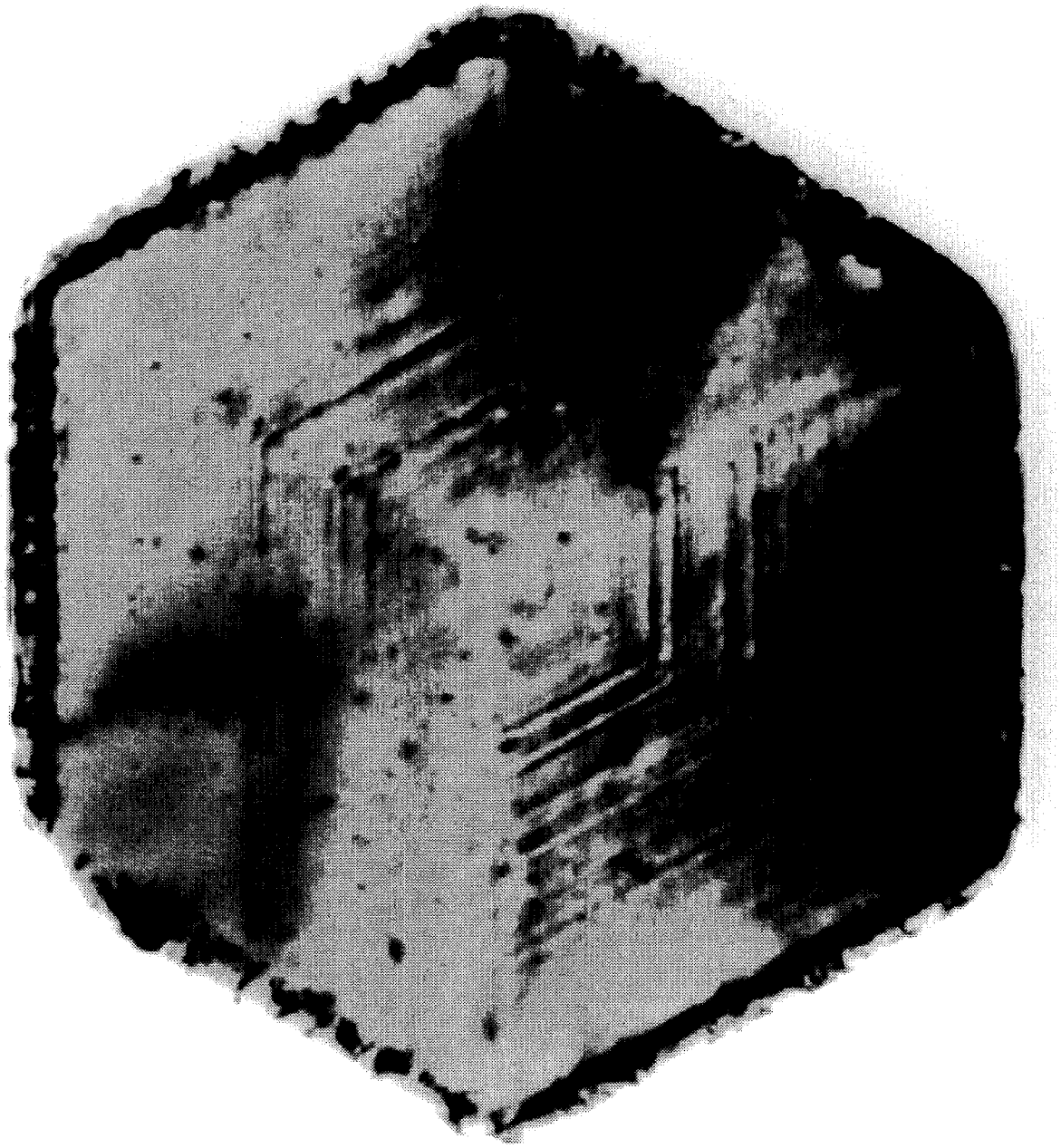
FIG. 1 is an electron micrograph of an emulsion having dislocations.

The present invention will be described in detail below.

An emulsion of the present invention contains one or more tabular silver halide grains having an aspect ratio of 2 or more. In the present invention, a "tabular grain" is a general term of grains having one twinning plane or two or more parallel twinning planes. When all ions at lattice points on both sides of a (111) plane have a mirror image relationship, this (111) plane is a twinning plane. When this tabular grain is viewed from top, its shape may be a triangle, a hexagon, or a rounded triangle- or hexagon-like circle. The triangular, hexagonal and circular grains have parallel triangular, hexagonal and circular outer surfaces, respectively.

In the present invention, the average aspect ratio of tabular grains is obtained as follows. That is, a value (aspect ratio) obtained by dividing a grain diameter by a thickness is calculated for each of tabular grains having a grain thickness of less than 0.5 μm and a grain diameter of 0.3 μm or more. Projected areas of these grains are added starting from those having higher aspect ratios. When the sum of the projected areas of the grains reaches a certain ratio (for example, 50%) of the total projected area, an average value of the aspect ratios of these grains is calculated as the average aspect ratio. Measurement of the grain thickness can be easily performed as follows. A metal is obliquely deposited together with a latex as a reference on a grain, and the length of its shadow is measured on an electron micrograph. The grain thickness is calculated by referring the resultant value thus measured to the length of the shadow of the latex.

In the present invention, the grain size is a diameter of a circle having an area equal to a projected area of parallel outer surfaces of a grain.

The projected area of a grain can be obtained by measuring an area on an electron micrograph and correcting it by a photographing magnification.

The diameter of a tabular grain is preferably 0.3 to 5.0 μm, and its thickness is preferably 0.05 to 0.5 μm.

The ratio of tabular grains of the present invention in an emulsion is preferably 50% or more, and most preferably 80% or more of the total projected area of silver halide grains in the emulsion. In addition, the average aspect ratio of these tabular grains which occupy the predetermined area in the emulsion is preferably from 3 to less than 8. It is sometimes possible to obtain more preferable effects by using monodisperse tabular grains. Although the structure and the method of manufacturing monodisperse tabular grains are described in, e.g., JP-A-63-151618, the shape of the grains will be briefly described below. That is, a hexagonal tabular silver halide, in which the ratio of an edge having the maximum length with respect to the length of an edge having the minimum length is 2 or less, and which has two parallel faces as outer surfaces, accounts for 70% or more of the total projected area of silver halide grains. In addition, the monodispersibility of the grains are such that a variation coefficient of a grain size distribution of these hexagonal tabular silver halide grains [i.e., a value obtained by dividing a variation (standard deviation) in grain sizes, which are represented by equivalent-circle diameters of projected areas of the grains, by their average grain size] is 20% or less.

The tabular grain of the present invention has dislocations.

Dislocations of the tabular grains can be observed by a direct method performed at a low temperature using a transmission electron microscope, as described in, for example, J. F. Hamilton, Phot. Sci. Eng., 11, 57, (1967) or T. Shiozawa, J. Soc. Phot. Sci. Japan, 35,213, (1972). That is, silver halide grains are carefully extracted from an emulsion so as not to impose a pressure to the grain, which may cause a dislocation in the grains, and are placed on a mesh for electron microscopic observation. The sample is observed by a transmission method while being cooled to prevent damage (e.g., print out) from electron rays. In this case, as the thickness of a grain is increased, it becomes more difficult to transmit electron rays through it. Therefore, grains can be observed more clearly by using an electron microscope of a high voltage type (200 kV or more for a grain having a thickness of 0.25 μm). Photographs of grains obtained by this method show positions of dislocations in each grain as viewed in a direction perpendicular to the major faces thereof.

In the tabular grain of the present invention, each of the dislocations is present such that the dislocation extends, to an edge of the grain, from a position (a start position of the dislocation) which is away from the center of the long axis of the grain by a distance corresponding to x% of the length from the center to the edge. The value of x is preferably $10 \leqq x < 100$, more preferably $30 \leqq x < 98$, and most preferably $50 \leqq x < 95$. In this case, although a shape obtained by connecting the start positions of the dislocations is almost similar to the shape of the grain, it is not perfectly similar but is sometimes distorted. The direction of dislocation lines is mostly from the center to the edges but is often zigzagged.

As to the tabular grains of the present invention, it is preferred that at least 50% (in number), more preferably at least 80% (in number) of the tabular grains have 10 or more dislocations. Most preferably, at least 80% (in number) of the tabular grans have 20 or more dislocations.

The manufacturing method of the tabular grain of the present invention will be described below.

The tabular grain of the present invention can be prepared by improving the methods described in, e.g., Cleve, "Photography Theory and Practice (1930)," page 13; Gutoff, "Photographic Science and Engineering," Vol. 14, pp. 248 to 257, (1970); U.S. Pat. Nos. 4,434,226, 4,414,310, 4,433,048, and 4,439,520; and British Patent 2,112,157.

In the tabular silver halide emulsion used in the present invention, it is possible to use any kind of silver halides selected from silver bromide, silver bromoiodide, silver bromochloroiodide and silver chlorobromide. A preferable silver halide is a silver bromoiodide or silver bromochloroiodide containing 30 mol % or less silver iodide.

The silver halide emulsion of the present invention may have a specific structure for a halogen composition in a grain.

Dislocations of the tabular grain of the present invention can be introduced by forming an iodide rich phase in a grain.

The iodide rich phase means a silver halide solid solution containing iodide. In this case, a silver halide is preferably silver iodide, silver bromoiodide, or silver bromochloroiodide, more preferably silver iodide or silver bromoiodide, and most preferably silver iodide.

The amount (silver content) of a silver halide for the iodide rich phase is preferably 30 mol % or less, and more preferably 10 mol % or less with respect to the silver content of a whole grain.

A phase to be grown outside the iodide rich phase must have an iodide content lower than that of the iodide rich phase. This iodide content is preferably 0 to 12 mol %, more preferably 0 to 6 mol %, and most preferably 0 to 3 mol %.

Sensitizing dyes represented by Formulas (A), (B), and (C) will be described in more detail below.

Examples of an alkyl group, which may be substituted, represented by $R^3$ or $R^4$ are an alkyl group having 1 to 18, preferably 1 to 7, and most preferably 1 to 4 carbon atoms {(an unsubstituted alkyl group (e.g., methyl, ethyl, propyl, isopropyl, butyl, isobutyl, hexyl, octyl, dodecyl, and octadecyl), and a substituted alkyl group, for example, an aralkyl group (e.g., benzyl and 2-phenylethyl), a hydroxyalkyl group (e.g., 2-hydroxyethyl and 3-hydroxypropyl), a carboxyalkyl group (e.g., 2-carboxyethyl, 3-carboxypropyl, 4-carboxybutyl, and carboxymethyl), an alkoxyalkyl group (e.g., 2-methoxyethyl, 2-(2-methoxyethoxy)ethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, and 3-sulfopropoxyethoxyethyl), a sulfatoalkyl group (e.g., 3-sulfatopropyl and 4-sulfatobutyl), a heterocyclic substituted alkyl group (e.g., 2-(pyrrolidine-2-one-1-yl)ethyl and tetrahydrofurfuryl), 2-acetoxyethyl, carbomethoxymethyl, and 2-methanesulfonylaminoethyl)}, and an allyl group.

One of $R^3$ and $R^4$ is preferably a sulfoalkyl group or a carboxyalkyl group.

$R^5$ represents a hydrogen atom, an alkyl group which may be substituted (e.g., methyl, ethyl, or benzyl) or an aryl group which may be substituted (e.g., phenyl or p-tolyl). $R^5$ is most preferably ethyl.

$X^-$ represents an inorganic or organic anion (e.g., chloride, bromide, iodide, p-toluenesulfonate, p-nitrobenzenesulfonate, methanesulfonate, methylsulfate, ethylsulfate, perchlorate, or 1,5-naphthalenedisulfonate).

n represents a value for adjusting an electric charge of the whole molecule. When an inner salt is to be formed, n is 0.

Sensitizing dyes represented by Formulas (A), (B) and (C) for use in the present invention can be easily synthesized by methods described in, e.g., F. M. Hamer, "Heterocyclic Compounds-Cyanine Dyes and Related Compounds," Chapters 4, 5 and 6, pp. 86 to 119, John Wiley and Sons (1964); and D. M. Sturmer, "Heterocyclic Compounds-Special Topics in Heterocyclic Chemistry," Chapter 8, pp. 482 to 515, John Wiley and Sons (1977).

Specific examples of sensitizing dyes represented by Formulas (A), (B), and (C) for use in the present invention will be listed in Tables 1, 2, and 3 below, but the present invention is not limited to these examples.

TABLE 1

(A)

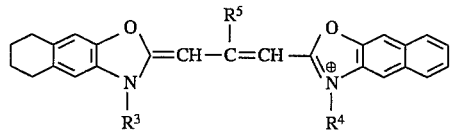

| A-No. | $R_3$ | $R_4$ | $R_5$ |
|---|---|---|---|
| 1 | $CH_3$ | $(CH_2)_3SO_3-$ | H |
| 2 | $CH_3$ | $(CH_2)_3SO_3-$ | $CH_3$ |
| 3 | $CH_3$ | $(CH_2)_3SO_3-$ | $C_2H_5$ |
| 4 | $CH_3$ | $(CH_2)_3SO_3-$ | $C_6H_5$ |
| 5 | $C_2H_5$ | $(CH_2)_3SO_3-$ | H |
| 6 | $C_2H_5$ | $(CH_2)_3SO_3-$ | $CH_3$ |
| 7 | $C_2H_5$ | $(CH_2)_3SO_3-$ | $C_2H_5$ |
| 8 | $C_2H_5$ | $(CH_2)_3SO_3-$ | $C_6H_5$ |
| 9 | $(CH_2)_3SO_3K$ | $(CH_2)_3SO_3-$ | H |
| 10 | $(CH_2)_3SO_3K$ | $(CH_2)_3SO_3-$ | $CH_3$ |

TABLE 1-continued (A)

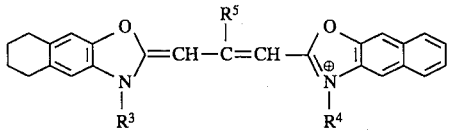

| A-No. | $R_3$ | $R_4$ | $R_5$ |
|---|---|---|---|
| 11 | $(CH_2)_3SO_3K$ | $(CH_2)_3SO_3-$ | $C_2H_5$ |
| 12 | $(CH_2)_3SO_3K$ | $(CH_2)_3SO_3-$ | $C_6H_5$ |
| 13 | $CH_3$ | $(CH_2)_4SO_3-$ | H |
| 14 | $CH_3$ | $(CH_2)_4SO_3-$ | $CH_3$ |
| 15 | $CH_3$ | $(CH_2)_4SO_3-$ | $C_2H_5$ |
| 16 | $CH_3$ | $(CH_2)_4SO_3-$ | $C_6H_5$ |
| 17 | $C_2H_5$ | $(CH_2)_4SO_3-$ | H |
| 18 | $C_2H_5$ | $(CH_2)_4SO_3-$ | $CH_3$ |
| 19 | $C_2H_5$ | $(CH_2)_4SO_3-$ | $C_2H_5$ |
| 20 | $C_2H_5$ | $(CH_2)_4SO_3-$ | $C_6H_5$ |
| 21 | $(CH_2)_3SO_3K$ | $(CH_2)_4SO_3-$ | H |
| 22 | $(CH_2)_3SO_3K$ | $(CH_2)_4SO_3-$ | $CH_3$ |
| 23 | $(CH_2)_3SO_3K$ | $(CH_2)_4SO_3-$ | $C_2H_5$ |
| 24 | $(CH_2)_3SO_3K$ | $(CH_2)_4SO_3-$ | $C_6H_5$ |
| 25 | $C_2H_5$ | $-CH_2CH_2CH(SO_3^-)CH_3$ | H |
| 26 | $C_2H_5$ | $-CH_2CH_2CH(SO_3^-)CH_3$ | $CH_3$ |
| 27 | $C_2H_5$ | $-CH_2CH_2CH(SO_3^-)CH_3$ | $C_2H_5$ |
| 28 | $C_2H_5$ | $-CH_2CH_2CH(SO_3^-)CH_3$ | $C_6H_5$ |

TABLE 2

(B)

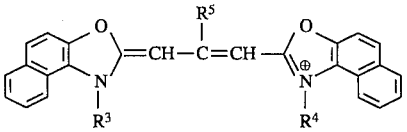

| B-No. | $R_3$ | $R_4$ | $R_5$ |
|---|---|---|---|
| 1 | $CH_3$ | $(CH_2)_3SO_3-$ | H |
| 2 | $CH_3$ | $(CH_2)_3SO_3-$ | $CH_3$ |
| 3 | $CH_3$ | $(CH_2)_3SO_3-$ | $C_2H_5$ |
| 4 | $CH_3$ | $(CH_2)_3SO_3-$ | $C_6H_5$ |
| 5 | $C_2H_5$ | $(CH_2)_3SO_3-$ | H |
| 6 | $C_2H_5$ | $(CH_2)_3SO_3-$ | $CH_3$ |
| 7 | $C_2H_5$ | $(CH_2)_3SO_3-$ | $C_2H_5$ |
| 8 | $C_2H_5$ | $(CH_2)_3SO_3-$ | $C_6H_5$ |
| 9 | $(CH_2)_3SO_3K$ | $(CH_2)_3SO_3-$ | H |
| 10 | $(CH_2)_3SO_3K$ | $(CH_2)_3SO_3-$ | $CH_3$ |
| 11 | $(CH_2)_3SO_3K$ | $(CH_2)_3SO_3-$ | $C_2H_5$ |
| 12 | $(CH_2)_3SO_3K$ | $(CH_2)_3SO_3-$ | $C_6H_5$ |
| 13 | $CH_3$ | $(CH_2)_4SO_3-$ | H |
| 14 | $CH_3$ | $(CH_2)_4SO_3-$ | $CH_3$ |
| 15 | $CH_3$ | $(CH_2)_4SO_3-$ | $C_2H_5$ |
| 16 | $CH_3$ | $(CH_2)_4SO_3-$ | $C_6H_5$ |
| 17 | $C_2H_5$ | $(CH_2)_4SO_3-$ | H |
| 18 | $C_2H_5$ | $(CH_2)_4SO_3-$ | $CH_3$ |
| 19 | $C_2H_5$ | $(CH_2)_4SO_3-$ | $C_2H_5$ |
| 20 | $C_2H_5$ | $(CH_2)_4SO_3-$ | $C_6H_5$ |
| 21 | $(CH_2)_3SO_3K$ | $(CH_2)_4SO_3-$ | H |
| 22 | $(CH_2)_3SO_3K$ | $(CH_2)_4SO_3-$ | $CH_3$ |
| 23 | $(CH_2)_3SO_3K$ | $(CH_2)_4SO_3-$ | $C_2H_5$ |
| 24 | $(CH_2)_3SO_3K$ | $(CH_2)_4SO_3-$ | $C_6H_5$ |

TABLE 2-continued (B)

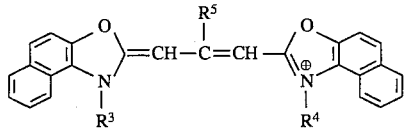

| B-No. | $R_3$ | $R_4$ | $R_5$ |
|---|---|---|---|
| 25 | $C_2H_5$ | $-CH_2CH_2CH(SO_3^-)CH_3$ | H |
| 26 | $C_2H_5$ | $-CH_2CH_2CH(SO_3^-)CH_3$ | $CH_3$ |
| 27 | $C_2H_5$ | $-CH_2CH_2CH(SO_3^-)CH_3$ | $C_2H_5$ |
| 28 | $C_2H_5$ | $-CH_2CH_2CH(SO_3^-)CH_3$ | $C_6H_5$ |

TABLE 3

(C)

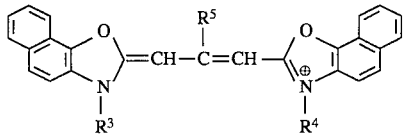

| C-No. | $R_3$ | $R_4$ | $R_5$ |
|---|---|---|---|
| 1 | $CH_3$ | $(CH_2)_3SO_3-$ | H |
| 2 | $CH_3$ | $(CH_2)_3SO_3-$ | $CH_3$ |
| 3 | $CH_3$ | $(CH_2)_3SO_3-$ | $C_2H_5$ |
| 4 | $CH_3$ | $(CH_2)_3SO_3-$ | $C_6H_5$ |
| 5 | $C_2H_5$ | $(CH_2)_3SO_3-$ | H |
| 6 | $C_2H_5$ | $(CH_2)_3SO_3-$ | $CH_3$ |
| 7 | $C_2H_5$ | $(CH_2)_3SO_3-$ | $C_2H_5$ |
| 8 | $C_2H_5$ | $(CH_2)_3SO_3-$ | $C_6H_5$ |
| 9 | $(CH_2)_3SO_3K$ | $(CH_2)_3SO_3-$ | H |
| 10 | $(CH_2)_3SO_3K$ | $(CH_2)_3SO_3-$ | $CH_3$ |
| 11 | $(CH_2)_3SO_3K$ | $(CH_2)_3SO_3-$ | $C_2H_5$ |
| 12 | $(CH_2)_3SO_3K$ | $(CH_2)_3SO_3-$ | $C_6H_5$ |
| 13 | $CH_3$ | $(CH_2)_4SO_3-$ | H |
| 14 | $CH_3$ | $(CH_2)_4SO_3-$ | $CH_3$ |
| 15 | $CH_3$ | $(CH_2)_4SO_3-$ | $C_2H_5$ |
| 16 | $CH_3$ | $(CH_2)_4SO_3-$ | $C_6H_5$ |
| 17 | $C_2H_5$ | $(CH_2)_4SO_3-$ | H |
| 18 | $C_2H_5$ | $(CH_2)_4SO_3-$ | $CH_3$ |
| 19 | $C_2H_5$ | $(CH_2)_4SO_3-$ | $C_2H_5$ |
| 20 | $C_2H_5$ | $(CH_2)_4SO_3-$ | C6H |
| 21 | $(CH_2)_3SO_3K$ | $(CH_2)_4SO_3-$ | H |
| 22 | $(CH_2)_3SO_3K$ | $(CH_2)_4SO_3-$ | $CH_3$ |
| 23 | $(CH_2)_3SO_3K$ | $(CH_2)_4SO_3-$ | $C_2H_5$ |
| 24 | $(CH_2)_3SO_3K$ | $(CH_2)_4SO_3-$ | $C_6H_5$ |
| 25 | $C_2H_5$ | $-CH_2CH_2CH(SO_3^-)CH_3$ | H |
| 26 | $C_2H_5$ | $-CH_2CH_2CH(SO_3^-)CH_3$ | $CH_3$ |
| 27 | $C_2H_5$ | $-CH_2CH_2CH(SO_3^-)CH_3$ | $C_2H_5$ |

TABLE 3-continued (C)

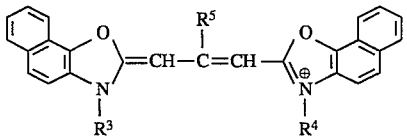

| C-No. | $R_3$ | $R_4$ | $R_5$ |
|---|---|---|---|
| 28 | $C_2H_5$ | $-CH_2CH_2CH(SO_3^-)CH_3$ | $C_6H_5$ |

Sensitizing dyes represented by Formulas (A), (B) and (C) of the present invention can be added in any step of a process of manufacturing the silver halide photographic light-sensitive material.

In order to add compounds represented by Formulas (A), (B) and (C) of the present invention to a silver halide, they may be dispersed directly in an emulsion. Alternatively, they can be dissolved in a solvent such as water, methanol, ethanol, acetone, methylcellosolve, or fluorinated alcohol, or in a mixture of these solvents, and the resultant solution may be added to an emulsion. When the compounds are added to the silver halide emulsion, they may be added during a silver halide grain formation process or added after silver halide grains are manufactured. When the compounds are added during the silver halide grain formation process, they can be added during a process in which silver and halogen react with each other, during a physical ripening process, immediately before a chemical ripening (post-ripening) process, during the chemical ripening process, or immediately after the chemical ripening process.

These compounds may be directly added to an emulsion, or a solution prepared by dissolving any of the compounds in a solvent which is essentially immiscible with water, such as phenoxyethanol, may be dispersed in water or a hydrophilic colloid either directly or by using a surfactant, and the resultant dispersion may be added to an emulsion.

Although the addition amount of sensitizing dyes represented by Formulas (A), (B), and (C) for use in the present invention largely varies depending on the type of a silver halide emulsion, it is normally $4\times10^{-6}$ to $8\times10^{-3}$ mol per mol of silver halide.

The amount to be used of a polymer having a repeating unit represented by Formula (I) of the present invention must be appropriately changed in accordance with conditions such as the type of the polymer or the type of tabular grains used. The intended effect of the present invention, however, can be obtained over the range of an amount smaller than that adopted when the polymer having a repeating unit represented by Formula (I) of the present invention is used as a protective colloid or a binder. The amount figured out as a weight of a repeating unit represented by Formula (I) contained in the polymer of the present invention is preferably 0.02 to 10 g, more preferably 0.02 to 7 g, and most preferably 0.1 to 5 g per mol of silver. The polymer having a repeating unit represented by Formula (I) of the present invention will be described in more detail below.

In a preferable example of the polymer containing a repeating unit represented by Formula (I) for use in the present invention, $R^1$ represents a hydrogen atom and Q represents one of i) to iii) below.

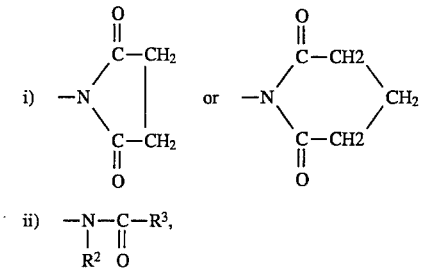

wherein $R^2$ represents methyl or ethyl group, and $R^3$ represents a hydrogen atom, methyl or ethyl.

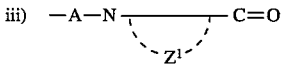

wherein A represents a single bond or

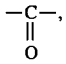

and $Z^1$ forms a 5- or 6-membered lactam ring or an oxazolidone ring.

Q more preferably represents

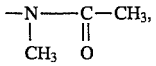

a pyrrolidone moiety, or an oxazolidone moiety, and most preferably a pyrrolidone moiety.

The polymer having a repeating unit represented by Formula (I) need not be a homopolymer but may also be a copolymer.

More specifically, this polymer is a polymer obtained by homopolymerization of a monomer represented by the following Formula (IA), copolymerization between two or more of these monomers, or copolymerization between the monomer and an ethylenically unsaturated compound which can be addition-polymerized with the monomer.

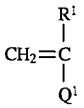

Formula (IA)

wherein Q1 represents one of (1) to (4) below.

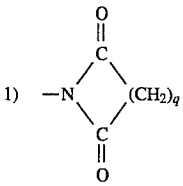

1) (wherein q represents an integer of 2 to 4),

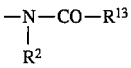

2)

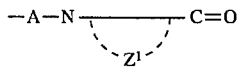

3)

-continued

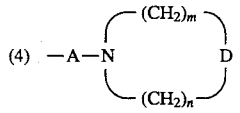

wherein $R_1$, $R_2$, $R_{13}$, A, $Z_1$, D, m and n have the same meanings as in Formula (I).

Examples of a monomer represented by Formula (IA) are N-vinylsuccinimide, N-vinylglutarimide, N-vinyladipimide, N-vinylacetamide, N-methyl-N-vinylformamide, N-methyl-N-vinylacetamide, N-ethyl-N-vinylacetamide, N-methyl-N-vinylpropionamide, N-vinylpyrrolidone, N-vinylpiperidone, N-vinyl-n-caprolactam, N-vinyloxazolidone, N-acryloylpyrrolidone, N-acryloyloxyethylpyrrolidone, N-acryloylmorpholine, N-acryloylpiperidine, N-methacryloylmorpholine, N-β-morpholinoethylacrylamide, N-vinylmorpholine and N-vinyl-2-pyridone. Of these examples, the monomer is preferably N-vinylsuccinimide, N-vinylglutarimide, N-methyl-N-vinylacetamide, N-ethyl-N-vinylacetamide, N-vinylpyrrolidone, N-vinylpiperidone or N-vinyloxazolidone, and most preferably N-methyl-N-vinylacetamide, N-vinylpyrrolidone or N-vinyloxazolidone.

Examples of the addition-polymerizable ethylenically unsaturated compound for forming a copolymer together with a monomer represented by Formula (IA) are acrylates, methacrylates, acrylamides, methacrylamides, an allyl compound, vinylethers, vinylesters, a vinyl heterocyclic compound, styrenes, maleates, fumarates, itaconates, crotonates, and olefins.

Specific examples are methylacrylate, ethylacrylate, isopropylacrylate, n-butylacrylate, octylacrylate, 2-chloroethylacrylate, 2-cyanoethylacrylate, N-(β-dimethylaminoethyl)acrylate, benzylacrylate, cyclohexylacrylate, and phenylacrylate; methylmethacrylate, n-propylmethacrylate, isopropylmethacrylate, n-butylmethacrylate, cyclohexylmethacrylate, and 3-sulfopropylmethacrylate; allylbutylether, allylphenylether; methylvinylether and butylvinylether; methoxyethylvinylether, 2-hydroxyethylvinylether, (2-dimethylaminoethyl)vinylether, vinylphenylether, vinylchlorophenylether, acrylamide, methacrylamide, N-methylacrylamide, N-(1,1-dimethyl-3-oxobutyl)acrylamide, N(1,1-dimethyl-3-hydroxybutyl)acrylamide, N,N-dimethylacrylamide, acryloylhydrazine, N-methoxymethylmethacrylamide, N-(1,1-dimethyl-3- hydroxybutyl)methacrylamide and N-hydroxymethylacrylamide; vinylpyridine, N-vinylimidazole, N-vinylcarbazole, and vinylthiophene; styrene, chloromethylstyrene, p-acetoxystyrene and p-methylstyrene; p-vinylbenzoic acid and methyl p-vinylbenzoate; crotoneamide, butylcrotonate and glycerinemonocrotonate; methylvinylketone and phenylvinylketone; ethylene, propylene, 1-butene, dicyclopentadiene, 4-methyl-1-hexene and 4,4-dimethyl-1-pentene; methylitaconate, ethylitaconate and diethylitaconate; methylsorbicate, ethylmaleate, butylmaleate, dibutylmaleate and octylmaleate; ethylfumarate, dibutylfumarate and octylfumarate; halogenated olefins, such as vinyl chloride, vinylidene chloride and isoprene; and unsaturated nitriles, such as acrylonitrile and methacrylonitrile. Two or more types of these compounds can be used in accordance with the application.

Of these compounds, examples preferable in terms of hydrophilic nature of a produced polymer are acrylic acid, methacrylic acid, 2-hydroxyethylacrylate, 2-methoxyethylacrylate, sulfopropylacrylate, acrylamide, dimethylacrylamide, 2-acryloylamino-2-methylpropanesulfonic acid, hydroxyethylacrylamide, methacrylamide, methylvinylether, soda styrenesulfonate, N-vinyl-3,5-dimethyltriazole and maleic anhydride. Although the composition ratio of the copolymer having a repeating unit represented by Formula (I) is not particularly limited, a component represented by Formula (I) may preferably occupy 10 to 100 mol %, and most preferably 50 to 100 mol %.

Synthesis of these polymers or copolymers having a repeating unit represented by Formula (I) can be performed in accordance with methods described in British Patent 1,211,039, JP-B-47-29195, JP-A-48-76593, JP-A-48-92022, JP-A-49-21134, JP-A-49-120634, British Patent 961,395, and U.S. Pat. Nos. 3,227,672, 3,290,417, 3,262,919, 3,245,932, 2,681,897 and 3,230,275; John C. Petropoulos et al., "Official Digest," Vol. 33, pp. 719 to 736 (1961); and Shunsuke Murahashi et al., "Synthetic Polymer," Vol. 1, pp. 246 to 290, and vol. 3, pp. 1 to 108. Conditions such as the polymerization initiator, the concentration, the polymerization temperature, and the reaction time can be widely and easily changed in accordance with the intended use.

For example, polymerization is generally performed at 20° C. to 180° C., preferably 40° C. to 120° C. by using a radical polymerization initiator in an amount of 0.05 to 5 wt % with respect to a monomer to be polymerized. Examples of the initiator are an azobis compound, peroxide, hydroperoxide, and a redox catalyst, for example, potassium persulfate, tert-butylperoctoate, benzoylperoxide, azobisisobutylnitrile, 2,2'-azobiscyanovalerianic acid, and 2,2'-azobis-(2-amidiopropanehydrochloride).

The molecular weight of the above-mentioned polymer used in the present invention is normally about 2,000 or more, and preferably about 8,000 to 700,000. These values, however, are not critical to obtain the effect of the present invention.

Representative examples of the polymer having a repeating unit represented by Formula (I) of the present invention are as follows.

(1) Poly(N-vinylpyrrolidone)
(2) Poly(N-vinyloxazolidone)
(3) Poly(N-vinylsuccinimide)
(4) Poly(N-vinylglutarimide)
(5) Poly(N-vinylpiperidone)
(6) Poly(N-vinyl-n-caprolactam)
(7) Poly(N-methyl-N-vinylacetamide)
(8) Poly(N-ethyl-N-vinylacetamide)
(9) Poly(N-vinylacetamide)
(10) Vinylalcohol-N-vinylacetamide copolymer (molar ratio=30:70)
(11) Vinylalcohol-N-vinylpyrrolidone copolymer (molar ratio=20:80)
(12) Vinylalcohol-N-vinylpyrrolidone copolymer (molar ratio=30:70)
(13) N-vinylpyrrolidone-vinylacetate copolymer (molar ratio=70:30)
(14) N-vinylpyrrolidone-2-hydroxyethylacrylate copolymer (molar ratio=70:30)
(15) N-vinylpyrrolidone-acrylic acid copolymer (molar ratio=90:10)
(16)N-vinylpyrrolidone-N-vinyl-3,5-dimethyltriazole copolymer (molar ratio=50:50)
(17) N-vinylpiperidone-2-methoxyethylacrylate copolymer (molar ratio=70:30)
(18) N-vinylpiperidone-methylvinylether copolymer (molar ratio=90:10)
(19) N-vinyloxazolidone-vinylalcohol copolymer (molar ratio=65:35)
(20) N-vinyloxazolidone-acrylic acid copolymer (molar ratio=80:20)

(21) N-vinylpyrrolidone-N-vinylpiperidone-2-hydroxyethylacrylate copolymer (molar ratio=40:30:30)

(22) Vinylalcohol-vinylacetate-N-vinyl-2-pyridone copolymer (molar ratio=70:25:5)

(23) N-vinylpyrrolidone-2-hydroxyethylacrylate-vinylacetate copolymer (molar ratio=70:20:10)

(24) N-vinylpyrrolidone-vinylalcohol-vinylpropionate-sodium styrenesulfonate copolymer (molar ratio=40 40:5:15)

(25) N-vinylpyrrolidone-acrylamide copolymer (molar ratio=60:40)

(26) N-vinylpyrrolidone-2-acrylamide-2-methylpropanesulfonic acid copolymer (molar ratio=75:25)

(27) N-vinylpiperidone-acrylamide copolymer (molar ratio=60:40)

(28) N-vinyloxazolidone-N-(2-hydroxyethyl)acrylamide copolymer (molar ratio=70:30)

(29) N-vinyloxazolidone-N-vinylmorpholine-acrylamide copolymer (molar ratio=50:20:30)

(30) N-vinylsuccinimide-N-vinyl-e-caprolactam-acrylamide copolymer (molar ratio=40:20:40)

(31) N-vinyloxazolidone-acrylamide-acrylic acid copolymer (molar ratio=60:20:20)

(32) N-vinylpyrrolidone-acrylamide-vinylacetate-acrylic acid copolymer (molar ratio=60:20:10:10)

(33) N-vinylpyrrolidone-dimethylacrylamide copolymer (molar ratio=70:30)

A polymer used in the present invention and containing a repeating unit represented by the following Formula (II) will be described below.

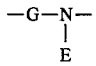

Formula (II)

wherein E represents $—COR_{21}$, $—COOR_{22}$, $—CONHR_{23}$, $—CONHCOR_{24}$, or $—SO_2R_{25}$ {wherein each of $R_{21}$, $R_{22}$, $R_{23}$, $R_{24}$, and $R_{25}$ represents a substituted or unsubstituted alkyl group (e.g., methyl, ethyl, isobutyl, octadecyl, monochloromethyl or hydroxyethyl), an aryl group (e.g., phenyl, tolyl or naphthyl), a cycloalkyl group (e.g., cyclopropyl, cyclohexyl or halogen-substituted cyclohexyl), or a hydrogen atom), and G represents an alkylene group having 2 to 5 carbon atoms (e.g., ethylene, propylene or isopropylene).

Examples of the polymer having a repeating unit represented by the above Formula (II) are a homopolymer or a copolymer obtained by ring-opening polymerization of at least one endo-imino cyclic compound represented by Formula (IIB) below; an alternating copolymer of at least one endo-imino cyclic compound described above with, e.g., gamma-propiolactone or propanesultone; a polymer obtained by ring-opening polymerization of ethyleneimide; and a polymer obtained by reacting a polymer, which is obtained by ring-opening polymerization of ethyleneimine, with an acid anhydride (acetic anhydride, propionic anhydride, succinic anhydride, or phthalic anhydride), an acid halide (e.g., acetylchloride, isobutyric acid chloride, lauric acid chloride, benzylchloride, or methanesulfonic acid chloride), chloroformate (e.g., methyl chloroformate, ethyl chloroformate, or dodecyl chloroformate), or isocyanate (e.g., ethylisocyanate, hexylisocyanate, or phenylisocyanate).

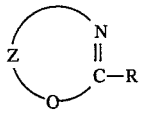

Formula (IIB)

wherein R represents a substituted or unsubstituted alkyl group (e.g., methyl, ethyl, isobutyl, octadecyl, monochloromethyl, or acetacetyl), a substituted or unsubstituted aryl group (e.g., phenyl, tolyl, or naphthyl), a substituted or unsubstituted cycloalkyl group (e.g., cyclopropyl, cyclohexyl, or halogen substituted cyclohexyl), or a hydrogen atom, and Z represents an alkylene group having 2 to 5 carbon atoms (e.g., ethylene, propylene, or isopropylene).

If the polymer having a repeating unit represented by Formula (II) according to the present invention is a copolymer, this copolymer contains preferably 5 mol % or more, and most preferably 10 mol % or more of a component represented by Formula (II) for obtaining better results.

The polymer having a repeating unit represented by Formula (II) according to the present invention can be obtained by various methods. For example, U.S. Pat. No. 3,483,141, "J. Polymer Sci.," Part A-1, Vol. 6, pp. 57 to 62 (1968), "J. Polymer Sci. Polymer Letters," Vol. 5, pp. 871 to 879 (1967), or JP-A-47-42987 describes that the polymer having the repeating unit can be obtained by heating a mixture of the endo-imino cyclic compound described above and a cation polymerization catalyst (e.g., dimethyl sulfate, methyl paratoluenesulfonate, methyl iodide, stannic chloride, or trifluorinated boron-etherate) at 50° C. to 180° C., and preferably 60° C. to 120° C. for 6 to 48 hours without using a solvent or after they are dissolved in an appropriate solvent (e.g., acetonitrile, nitrobenzene, or dimethylformamide).

The copolymer of the endo-imino cyclic compound and gamma-propiolactone or propanesultone can be obtained in accordance with the description in "Macromolecules," Vol. 5, pp. 354 to 358 or the announcement made by Takeo Saegusa, Koji Ikeda, Shigetoshi Hirayanagi et al. in the 19th Polymer Research Meeting (at Kobe, 1973). The method of obtaining the polymer formed by ring-opening polymerization of ethyleneimide according to the present invention is described in "Kogyo Kagaku Magazine," Vol. 58, pp. 123 to 126 (1955).

It is possible to use methods known to those skilled in the art in order to obtain the polymer according to the present invention by reacting an acid anhydride, an acid halide, chloroformate or isocyanate with polyethyleneimine obtained by polymerizing ethyleneimine. For example, this polymer can be obtained by dissolving polyethyleneimine in an appropriate solvent (e.g., water, pyridine, or dimethylformamide) and adding and reacting with, under cooling if necessary, a proper amount of an acid anhydride, an acid chloride, chloroformate, or isocyanate to the solution.

The degree of polymerization of the polymer having a repeating unit represented by Formula (II) according to the present invention is preferably 10 to 10,000, and most preferably about 50 to 500. These values, however, are not critical to obtain the effect of the present invention.

Specific examples of the polymer having a repeating unit represented by Formula (II) according to the present invention will be presented below, but the present invention is not limited to these examples.

I Ring-opening polymer of endo-imino cyclic compound.

1. Ring-opening polymer of 2-methyloxazoline.
Repeating Unit as component of polymer.
(to be simply referred to as unit hereinafter)

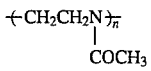

(n:200)

2. Ring-opening polymer of 2-isobutyloxazoline.
Unit

-continued $$\left(CH_2CH_2N\right)_n \quad (n:150)$$
$$\quad | \quad COCH(CH_3)_2$$

3. Ring-opening polymer of 2-n-octyloxazoline.
Unit $$\left(CH_2CH_2N\right)_n \quad (n:128)$$
$$\quad | \quad COC_8H_{17}$$

4. Ring-opening polymer of 2-dichloromethyloxazoline.
Unit $$\left(CH_2CH_2N\right)_n \quad (n:135)$$
$$\quad | \quad COCHCl_2$$

5. Ring-opening polymer of 2-trifluoromethyloxazoline.
Unit $$\left(CH_2CH_2N\right)_n \quad (n:215)$$
$$\quad | \quad COCF_3$$

6. Ring-opening polymer of 2-(betamethoxycarbonyl)ethyloxazoline.
Unit $$\left(CH_2CH_2N\right)_n \quad (n:80)$$
$$\quad | \quad COCH_2CH_2COOCH_3$$

7. Ring-opening polymer of 2-phenyloxazoline.
Unit

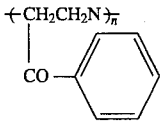

8. Ring-opening polymer of 2-cyclohexyloxazoline.
Unit

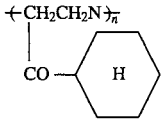

9. Ring-opening polymer of 2,5-dimethyl-2-oxazoline.
Unit $$\left(CH_2CH_2N\right)_n \quad (n:41)$$
$$CH_3 \quad COCH_3$$

10. Ring-opening polymer of 2-methyl-5, 6-dihydro-1,3-oxazine.
Unit $$\left(CH_2CH_2CH_2N\right)_n \quad (n:30)$$
$$\quad | \quad COCH_3$$

11. Copolymer of 2-methyloxazoline and 2-ethyloxazoline.
Unit $$\left(CH_2CH_2N\right) \qquad \left(CH_2CH_2N\right)$$
$$COCH_3 \qquad COC_2H_5$$

(molar ration 50:50, polymerization degree n:55)

II Alternating copolymer of endo-imino cyclic compound and another monomer.

12. Alternating copolymer of 2-methyloxazoline and propanesultone.
Unit $$\left(CH_2CH_2N-CH_2CH_2CH_2SO_2O\right)_n \quad (n:81)$$
$$\quad | \quad COCH_3$$

13. Alternating copolymer of 2-oxazoline and betapropiolacto.
Unit $$\left(CH_2CH_2N-CH_2CH_2COO\right)_n \quad (n:20)$$
$$\quad | \quad CHO$$

III Ring-opening polymer of ethyleneimide.

14. Ring-opening polymer of ethyleneimide acetoacetate.
Unit $$\left(CH_2CH_2N\right)_n \quad (n:62)$$
$$\quad | \quad COCH_2COCH_3$$

IV Polymer obtained by reacting acid anhydride with polyethyleneimine obtained by polymerizing ethyleneimine.

15. Polymer obtained by reacting polyethyleneimine (polymerization degree (n) = 80) with acetic anhydride.
Unit $$\left(CH_3CONHCH_2CH_2\right)_k \quad \left(CH_2CH_2N\right)_l$$
$$| \quad COCH_3$$
$$\left(CH_2CH_2N\right)_m$$

Composition ratio k:l:m=24:53:23

16. Polymer obtained by reacting polyethyleneimine (n = 50) with succinic anhydride.
Unit $$\left(HOCOCH_2CH_2CONHCH_2CH_2\right)_k$$
$$| \quad \left(CH_2CH_2N\right)_m$$
$$\left(CH_2CH_2N\right)_l$$
$$\quad | \quad COCH_2CH_2COOH$$

Composition ratio k:l:m=25:51:24

17. Polymer obtained by reacting polyethyleneimine (n = 100) with methyl chloroformate.
Unit $$\left(CH_3OCONHCH_2CH_2\right)_k \quad \left(CH_2CH_2N\right)_l$$
$$| \quad COOCH_3$$
$$\left(CH_2CH_2N\right)_m$$

Composition ratio k:l:m=23:50:27

18. Polymer obtained by reacting polyethyleneimine (n = 80) with octyl chloroformate.
Unit $$\left(C_8H_{17}OCONHC_2H_4\right)_k \quad \left(CH_2CH_2\right)_l$$
$$| \quad COOC_8H_{17}$$
$$\left(CH_2CH_2N\right)_m$$

Composition ratio k:l:m=24:53:23

19. Polymer obtained by reacting polyethyleneimine (n = 80) with ethylisocyanate.
Unit $$\left(C_2H_5NHCONHC_2H_4\right)_k \quad \left(CH_2CH_2N\right)_l$$
$$| \quad CONHC_2H_5$$
$$\left(CH_2CH_2N\right)_m$$

Composition ratio k:l:m=25:52:23

-continued

20. Polymer obtained by reacting polyethyleneimine (n = 80) with paratolylisocyanate.
Unit

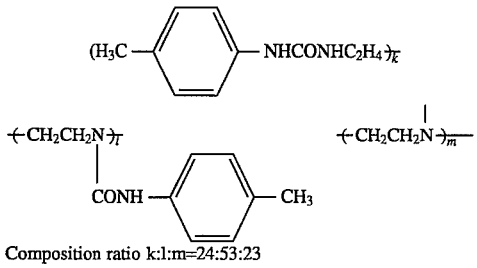

Composition ratio k:l:m=24:53:23

21. Polymer obtained by reacting polyethyleneimine (n = 100) with acetylisocyanate.
Unit

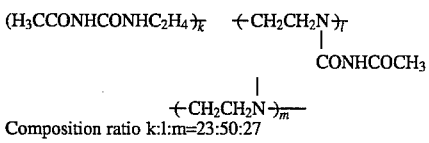

Composition ratio k:l:m=23:50:27

22. Polymer obtained by reacting polyethyleneimine (n = 80) with methanesulfonylchloride.
Unit

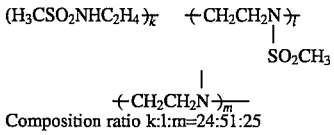

Composition ratio k:l:m=24:51:25

It is possible to arbitrarily select the addition amount of the polymer having a repeating unit represented by Formula (II) according to the present invention to light-sensitive silver halide emulsion layers. The amount is, however, preferably 1 to 500 g, and most preferably 5 to 300 g per mol of a silver halide. Although the addition amount thereof to non-light-sensitive auxiliary layers is not particularly limited, it is preferable to add 1 to 1,000 g, and most preferably 10 to 500 g per mol of a silver halide.

The polymer according to the present invention is preferably water-soluble. If, however, the polymer is hard to dissolve in water, it can be dissolved in an organic solvent (e.g., methanol, acetone, dioxane, or dimethylformamide) which is miscible with water and then added to the emulsion layers. In some cases, the polymer can be dissolved in an organic solvent (e.g., ethylacetate, butylacetate, dibutylphthalate, or N,N-diethyldodecaneamide) which is immiscible with water, then formed into a water dispersion (oil-protect dispersion) and then added to the emulsion layers.

Addition of the polymer having a repeating unit represented by Formula (I) or (II) according to the present invention is normally performed, in the case of a light-sensitive emulsion layer, after chemical ripening of the emulsion and before coating. In some cases, the addition is performed during or before the chemical ripening.

That is, in the silver halide emulsion grain formation process, the polymer can be added during addition of a silver salt solution, after the addition of a silver salt solution and before the chemical ripening, or during the chemical ripening.

In addition, when the polymer is added to non-light-sensitive auxiliary layers, it can be added either during or after preparation of a coating solution.

In the light-sensitive material of the present invention, at least one of blue-, green-, and red-sensitive silver halide emulsion layers need only be formed on a support, and the number and order of the silver halide emulsion layers and non-light-sensitive layers are not particularly limited. A typical example is a silver halide photographic light-sensitive material having, on its support, at least one light-sensitive layer constituted by a plurality of silver halide emulsion layers which are sensitive to essentially the same color but have different light sensitivities. This light-sensitive layer is a unit sensitive layer which is sensitive to one of blue light, green light, and red light. In a multilayered silver halide color photographic light-sensitive material, such unit light-sensitive layers are generally arranged in an order of red-, green-, and blue-sensitive layers from a support. However, according to the intended use, this arrangement order may be reversed, or light-sensitive layers sensitive to the same color may sandwich another light-sensitive layer sensitive to a different color.

A non-light-sensitive layer such as various types of interlayer may be formed between the silver halide light-sensitive layers, and as the uppermost layer or the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers each constituting unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the respective silver halide emulsion layers. In addition, as described in JP-A-57-112751, JP-A-62-200350, JP-A-62-206541, and JP-A-62-206543, layers may be arranged such that a low-sensitivity emulsion layer is formed on the side remote from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/R/H.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three-layer structure may be formed such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in one same color sensitive layer as described in JP-A-59-202464.

In addition, an order of high-sensitivity emulsion layer/low-sensitivity emulsion layer/medium-sensitivity emulsion layer or low-sensitivity emulsion layer/medium-sensitivity emulsion layer/high-sensitivity emulsion layer may be adopted. Furthermore, the arrangement can be changed as described above even when four or more layers are formed.

In order to improve color reproducibility, a donor layer (CL) with an interlayer effect, which is described in U.S. Pat. No. 4,663,271, 4,705,744, or 4,707,436, JP-A-62-160448, or JP-A-63-89580 and different from the main light-sensitive layers BL, GL, and RL in spectral sensitivity distribution, is preferably formed adjacent to or close to the main light-sensitive layers.

As described above, various layer types and arrangements can be selected according to the intended use of the light-sensitive material.

Silver halide grains except the tabular grain of the present invention will be described below.

A preferable silver halide contained in photographic emulsion layers of the photographic light-sensitive material of the present invention is silver bromoiodide, silver iodochloride, or silver bromochloroiodide containing about 30 mol % or less of silver iodide. The most preferable silver halide is silver bromoiodide or silver bromochloroiodide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having crystal defects such as twinning planes, or composite shapes thereof.

A silver halide may consist of fine grains having a grain size of about 0.2 μm or less or large grains having a projected area diameter of up to about 10 μm, and an emulsion may be either a polydisperse or monodisperse emulsion.

A silver halide photographic emulsion which can be used in the light-sensitive material of the present invention can be prepared by methods described in, for example, "I. Emulsion preparation and types," Research Disclosure (RD) No. 17,643 (December, 1978), pp. 22 and 23, RD No. 18,716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent 1,413,748 are also preferred.

A crystal structure may be uniform, may have different halogen compositions in the interior and the surface layer thereof, or may be a layered structure. Alternatively, a silver halide having a different composition may be bonded via an epitaxial junction to the crystal structure or a compound different from a silver halide, such as silver rhodanide or zinc oxide may be bonded to the crystal structure. A mixture of grains having various types of crystal shapes may be used.

The above emulsion may be any of a surface latent image type emulsion which mainly forms a latent image on the surface of a grain, an internal latent image type emulsion which forms a latent image in the interior a grain, and an emulsion of another type which has latent images on the surface and in the interior of a grain. However, the emulsion must be a negative type emulsion. In this case, the internal latent image type emulsion may be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably 5 to 20 nm.

A silver halide emulsion layer is normally subjected to physical ripening, chemical ripening, and spectral sensitization steps before it is used. Additives for use in these steps are described in Research Disclosure Nos. 17,643, 18,716, and 307,105, and they are summarized in a table to be presented later.

In the light-sensitive material of the present invention, it is possible to simultaneously use, in a single layer, two or more types of emulsions different in at least one of characteristics of a light-sensitive silver halide emulsion, i.e., a grain size, a grain size distribution, a halogen composition, a grain shape and a sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in light-sensitive silver halide emulsion layers and/or essentially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852.

A silver halide which forms the core of an internally fogged core/shell type silver halide grain may have either a single halogen composition or different halogen compositions. As the internally fogged or surface-fogged silver halide, any of silver chloride, silver chlorobromide, silver bromoiodide, and silver bromochloroiodide can be used. Although the grain size of these fogged silver halide grains is not particularly limited, the average grain size is preferably 0.01 to 0.75 μm, and most preferably 0.05 to 0.6 μm. Since the grain shape is not particularly limited either, regular grains may be used. The emulsion may be a polydisperse emulsion but is preferably a monodisperse emulsion (in which at least 95% in weight or the number of grains of silver halide grains have grain sizes falling within a range of ±40% of an average grain size).

In the present invention, it is preferable to use a non-light-sensitive fine grain silver halide. The non-light-sensitive fine grain silver halide preferably consists of silver halide grains which are not sensitized during imagewise exposure for obtaining a dye image and are not essentially developed during development. These silver halide grains are preferably not fogged in advance.

In the fine grain silver halide, the content of silver bromide is 0 to 100 mol %, and silver chloride and/or silver iodide may be added if necessary. The fine grain silver halide preferably contains 0.5 to 10 mol % of silver iodide.

The average grain size (average value of an equivalent-circle diameter of a projected area) of the fine grain silver halide is preferably 0.01 to 0.5 μm, and more preferably 0.02 to 2 μm.

The fine grain silver halide can be prepared following the same procedures as for a common light-sensitive silver halide. In this case, the surface of each silver halide grain need not be optically sensitized nor spectrally sensitized. However, before the silver halide grains are added to a coating solution, it is preferable to add a well-known stabilizer such as a triazole-based compound, an azaindene-based compound, a benzothiazolium-based compound, a mercapto-based compound, or a zinc compound. Colloidal silver can be preferably added to this fine grain silver halide grain-containing layer.

The silver coating amount of the light-sensitive material of the present invention is preferably 6.0 g/m$^2$ or less, and most preferably 4.5 g/m$^2$ or less.

Well-known photographic additives usable in the present invention are also described in the three Research Disclosures described above, and they are summarized in the following table.

| Additives | RD17643 | RD18716 | RD307105 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pages 23–24 | page 648, right column to page 649, right column | pages 866–868 |
| 4. Brighteners | page 24 | | page 868 |
| 5. Antifoggants and stabilizers | pages 24–25 | page 649, right column | pages 868–870 |
| 6. Light absorbent, filter dye, ultra-violet absorbents | pages 25–26 | page 649, right column to page 650, left column | page 873 |
| 7. Stain preventing agents | page 25, right column | page 650, left to right columns | page 872 |
| 8. Dye image stabilizer | page 25 | page 650, left column | page 872 |
| 9. Hardening agents | page 26 | page 651, left column | pages 874–875 |
| 10. Binder | page 26 | page 651, left column | pages 873–874 |
| 11. Plasticizers, lubricants | page 27 | page 650, right column | page 876 |
| 12. Coating aids, surface active agents | pages 26–27 | page 650, right column | pages 875–876 |
| 13. Antistatic agents | page 27 | page 65, right column | pages 876–877 |
| 14. Matting agent | | | pages 878–879 |

In order to prevent deterioration in photographic properties caused by formaldehyde gas, the light-sensitive material is preferably added with a compound described in U.S. Pat. No. 4,411,987 or 4,435,503, which can react with formaldehyde to fix it.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains a compound described in JP-A-l-106052, which releases a fogging agent, a development accelerator, a silver halide solvent, or a precursor of any of them regardless of a developed amount of silver produced by development.

The light-sensitive material of the present invention preferably contains dyes dispersed by methods described in WO 04794/88 and PCT No. 1-502912, or dyes described in EP 317,308A, U.S. Patent 4,420,555, and JP-A-1-259358.

Various color couplers can be used in the present invention, and specific examples of these couplers are described in patents described in above-mentioned Research Disclosure No. 17643, VII-C to VII-G and No. 307105, VII-C to VII-G.

Preferred examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 10 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,565,630, and WO No. 88/04795.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Patent Application (OLS) No. 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658. In addition, it is also possible to use pyrazoloazole couplers described in JP-A-64-553, JP-A-64-554, JP-A-64-555, and JP-A-64-556 or an imidazole coupler described in U.S. Pat. No. 4,818,672.

Typical examples of a polymerized dye-forming coupler are described in U.S. Pat. Nos. 3,451,820, 4,080,221, 4,367,288, 4,409,320, and 4,576,910, British Patent 2,102,173, and EP 341,188A.

Preferable examples of a coupler capable of forming colored dyes having proper diffusibility are those described in U.S. Patent 4,366,237, British Patent 2,125,570, EP 96,570, and West German Patent Application (OLS) No. 3,234,533.

Preferable examples of a colored coupler for correcting additional, undesirable absorption of a colored dye are those described in Research Disclosure No. 17643, VII-G and No. 307105, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a leaving group described in U.S. Pat. No. 4,777,120 may be preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Bleaching accelerator releasing couplers described in, e.g., RD Nos. 11449 and 24241 and JP-A-61-201247 can be effectively used to reduce the time required for a treatment having a bleaching function. This effect is notable especially when the coupler is added to a light-sensitive material using the tabular silver halide grains described above. Preferable examples of a coupler for imagewise releasing a nucleating agent or a development accelerator are described in British Patents 2,097,140 and 2,131,188, JP-A-59-157638, and JP-A-59-170840. It is also preferable to use compounds described in JP-A-60-107029, JP-A-60-252340, JP-A-1-44940, and JP-A-1-45687, which release, e.g., a fogging agent, a development accelerator, or a silver halide solvent upon a redox reaction with an oxidized form of a developing agent.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; bleaching accelerator releasing couplers described in, e.g., RD. Nos. 11,449 and 24,241 and JP-A-61-201247; a ligand releasing coupler described in, e.g., U.S. Pat. No. 4,553,477; a coupler which releases a leuco dye described in JP-A-63-75747; and a coupler which releases a fluorescent dye described in U.S. Pat. No. 4,774,181.

The couplers for use in this invention can be added to the light-sensitive material by various known dispersion methods.

Examples of a high-boiling organic solvent to be used in the oil-in-water dispersion method are described in, e.g., U.S. Patent 2,322,027. Examples of a high-boiling organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl) isophthalate, and bis(1,1-di-ethylpropyl)phthalate), phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoates (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylates (e.g., bis(2-ethylhexyl)sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

Steps and effects of a latex dispersion method and examples of an impregnating latex are described in, e.g., U.S. Pat. No. 4,199,363 and West German Patent Application (OLS) Nos. 2,541,274 and 2,541,230.

Various types of an antiseptic agent or a mildewproofing agent are preferably added to the color light-sensitive material of the present invention. Examples of the antiseptic agent and the mildewproofing agent are 1,2-benzisothiazoline-3-one, n-butyl-p-hydroxybenzoate, 2-phenoxyethanol, and 2-(4-thiazolyl)benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

A film swell speed $T_{1/2}$ of the light-sensitive material of the present invention is preferably 30 sec. or less, and more preferably, 20 sec. or less. The film thickness means a film thickness measured under moisture conditioning at a temperature of 25° C. and a relative humidity of 55% (two days). The film swell speed $T_{1/2}$ can be measured in accordance with a known method in this field of art. For example, the film swell speed $T_{1/2}$ can be measured by using a swell meter described in Photogr. Sci Eng., A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness—film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, page 615, the left to right columns, and RD No. 307105, pp. 880 and 881.

A color developer used in development of the light-sensitive material of the present invention is preferably an aqueous alkaline solution mainly consisting of an aromatic primary amine-based color developing agent. As this color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Of these compounds, 3-methyl-4-amino-N-ethyl-N-β-hydroxyethylaniline sulfate is most preferred. These compounds can be used in a combination of two or more thereof in accordance with the application.

In general, the color developer contains a Ph buffering agent such as a carbonate, a borate, or a phosphate of an alkali metal, and a development restrainer or an antifoggant such as a bromide, an iodide, a benzimidazole, a benzothiazole, or a mercapto compound. If necessary, the color developer may also contain a preservative such as hydroxylamine, diethylhydroxylamine, a hydrazine sulfite, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye forming coupler; a competing coupler; a fogging agent such as sodium boron hydride; an auxiliary developing agent such as 1-phenyl-3-pyrazolidone; a viscosity imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid) and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenyl such as N-methyl-p-aminophenol can be used singly or in a combination of two or more thereof. The pH of the color and black-and-white developers is generally 9 to 12. Although the quantity of replenisher of these developers depends on a color photographic light-sensitive material to be processed, it is generally 3 liters or less per $m^2$ of the light-sensitive material. The quantity of replenisher can be decreased to be 500 ml or less by decreasing a bromide ion concentration in the replenisher. In order to decrease the quantity of replenisher, a contact area of a processing tank with air is preferably decreased to prevent evaporation and oxidation of the replenisher upon contact with air. The quantity of replenisher can be decreased by using a means capable of suppressing an accumulation amount of bromide ions in the developer.

A contact area of a photographic processing solution with air in a processing tank can be represented by the ratio of aperture defined below:

$$\text{Ratio of aperture} = \frac{\text{contact area (cm}^2\text{) of processing solution with air}}{\text{volume (cm}^3\text{) of processing solution}}$$

The above ratio of aperture is preferably 0.1 or less, and more preferably, 0.001 to 0.05. In order to reduce the ratio of aperture, a shielding member such as a floating cover may be provided on the liquid surface of the photographic processing solution in the processing tank. In addition, a method of using a movable cover described in JP-A-1-82033 or a slit developing method descried in JP-A-63-216050 may be used. The ratio of aperture is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing storage of bromide ions in the developing solution.

A color development time is normally set to two to five minutes. The processing time, however, can be shortened by setting a high temperature and a high pH and using the color developing agent at a high concentration. The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, according to the intended use. Examples of the bleaching agent are a compound of a multivalent metal such as iron(III), peroxides, quinones, and a nitro compound. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-104232, JP-A-53-124424, and JP-A-53-141623, and JP-A-53-28426, and Research Disclosure No. 17,129 (July, 1978); a thiazolidine derivative described in JP-A-50-140129; iodide salts described in JP-B-45-8506, JP-A-52-20832, JP-A-53-32735, U.S. Pat. No. 3,706,561, and JP-A-58-16235; polyoxyethylene compounds descried in West German Patents 977,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, for example, acetic acid, propionic acid, or hydroxyacetic acid.

Examples of the fixing agent are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause turbulence on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyor means described in JP-A-60-191257, JP-A-191258, or JP-A-60-191259. As described in JP-A-60-191257, this conveyor means can significantly reduce carry-over of a processing solution from a pre-bath to a post-bath, thereby effectively preventing degradation in performance of the processing solution. Due to this effect, it has become possible to significantly shorten especially a processing time in each processing step and to reduce a processing solution replenishing amount.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the intended use of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing the photographic light-sensitive material of the present invention is 4 to 9, and preferably, 5 to 8. The water temperature and the washing time can vary in accordance with the properties and the intended use of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing a dye stabilizing agent and a surface-active agent to be used as a final bath of the photographic color light-sensitive material. Examples of the dye stabilizing agent are an aldehyde such as formalin and glutaraldehyde, an N-methylol compound, hexamethylenetetramine, and an aldehyde sulfurous acid adduct. Various chelating agents or antifungal agents can be added in the stabilizing bath.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, e.g., U.S. Pat. No. 4,500,626, JP-A-60-133449, JP-A-59-218443, JP-A-61-238056, and EP 210,660A2.

The present invention will be described in more detail below by way of its examples but is not limited to these examples.

EXAMPLE 1

(Preparation of Emulsion E-1 (grains containing dislocation lines))

(1) 1,000 ml of an aqueous solution containing 12 g of gelatin and 3.2 g of KBr was stirred at 60° C. (2) An aqueous silver nitrate solution ($AgNO_3$: 8.2 g) and an aqueous halide solution (KBr: 5.7g, KI: 0.35 g) were added by a double jet method over one minute. (3) After 21.5 g of gelatin were added, the resultant solution was heated to 75° C. (4) Thereafter, an aqueous silver nitrate solution ($AgNO_3$: 136.3 g) and an aqueous halide solution (containing 10 mol % of KI with respect to KBr) were added by the double jet method at an accelerated flow rate over 51 minutes. At this time, the silver potential was maintained at 0 mV with respect to a saturated calomel electrode for the first 46 minutes and then changed to +90 mV. (5) The temperature was decreased to 40° C., and an aqueous silver nitrate solution ($AgNO_3$: 3.2 g) and an aqueous KBr solution (KI: 2.3 g) were added by the double jet method over five minutes. (6) Thereafter, an aqueous silver nitrate solution ($AgNO_3$: 25.4 g) and an aqueous KBr solution were added by the double jet method for 5.35 minutes. At this time, the silver potential was maintained at −50 mV with respect to the saturated calomel electrode. (7) The resultant emulsion was desalted by a flocculation method and added with gelatin. The pH and the pAg were adjusted to be 5.5 and 8.7, respectively. In this emulsion E-1, 80% of the total projected area were accounted for by tabular grains having an average equivalent-circle diameter of 1.3 μm, an average thickness of 0.25 μm, an average aspect ratio of 5.2, and an average silver iodide content of 9.4 mol %.

(Preparation of Emulsion E-2 (grains not containing dislocation lines))

An emulsion was prepared following the same procedures as in the preparation of the emulsion E-1 in the procedure (5) except that an aqueous KI solution (KI: 2.3 g) was replaced with an aqueous KBr solution (KBr: 8.8 g). The emulsion E-2 consisted of tabular grains having an average equivalent-circle diameter of 1.4 μm, an average thickness of 0.21 μm, an average aspect ratio of 6.7, and a variation coefficient in equivalent-circle diameter of 24%. Optimal gold-sulfur sensitization was performed for each of the emulsions E-1 and E-2 in accordance with a conventional method.

(Observation of dislocation lines in grains)

Figure 2:
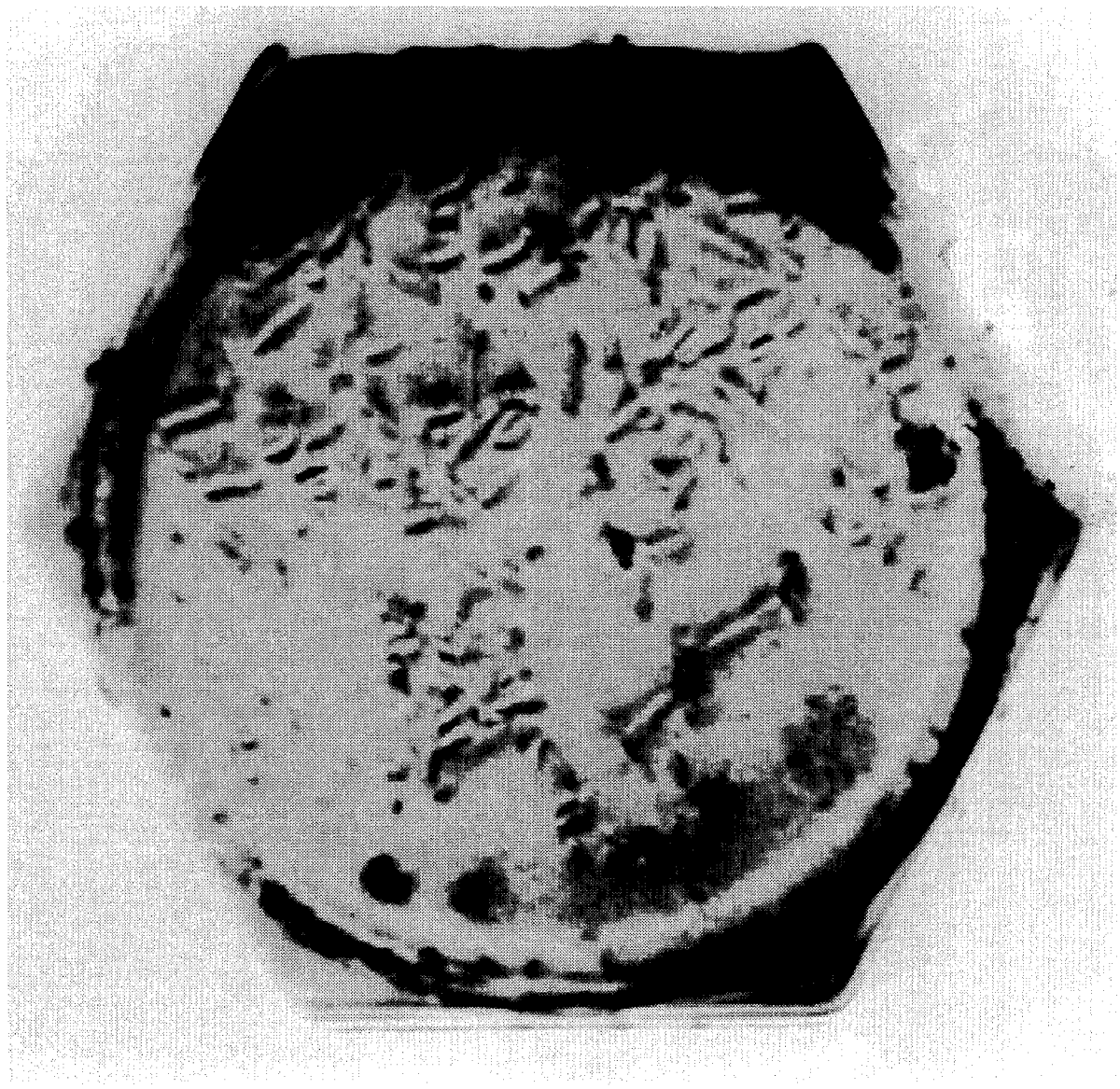
FIG. 2 is an electron micrograph of an emulsion having no dislocations.

Direct observation of dislocation lines was performed for each of the emulsions E-1 and E-2 by using a transmission electron microscope. The observation was performed by using JEM-2000FXII available from Nihon Denshi K.K. as the electron microscope at an acceleration voltage of 200 kV and a temperature of −120° C. FIG. 1 is an electron micrograph (magnification of 88,000) of the emulsion E-1, and FIG. 2 is an electron micrograph (magnification of 88,000) of the emulsion E-2. Dislocation lines were found in peripheral portions of grains of the emulsion E-1 as shown in FIG. 1, while no dislocation lines were found in the emulsion E-2 as shown in FIG. 2.

(Manufacture and evaluation of coated sample)

Layers having the following compositions were stacked on a subbed cellulose triacetate support to prepare a sample 101 as a multilayered color light-sensitive material.

(Compositions of light-sensitive layers)

Numbers corresponding to the respective components represent coating amounts in g/m$^2$. The amount of a silver halide is represented by a coating amount of silver. Note that the number corresponding to each sensitizing dye represents a coating amount (in mol) per mol of a silver halide in the same layer.

| (Sample 101) | |
|---|---|
| First layer (Antihalation layer) | |
| Black colloidal silver | silver 0.18 |
| Gelatin | 1.40 |
| ExM-1 | 0.18 |
| ExF-1 | $2.0 \times 10^{-3}$ |
| B-5 | 0.1 |
| Second layer (Interlayer) | |
| Emulsion G | 0.065 |
| 2,5-di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| Third layer (1st red-sensitive emulsion layer) | |
| Emulsion A | silver 0.25 |
| Emulsion B | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-4 | 0.17 |
| ExC-7 | 0.020 |
| UV-1 | 0.070 |
| UV-2 | 0.050 |
| UV-3 | 0.070 |
| HBS-1 | 0.060 |
| Gelatin | 0.87 |
| Fourth Layer (2nd red-sensitive emulsion layer) | |
| Emulsion D | silver 0.80 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.20 |
| ExC-2 | 0.050 |
| ExC-4 | 0.20 |
| ExC-5 | 0.050 |
| ExC-7 | 0.015 |
| UV-1 | 0.070 |
| UV-2 | 0.050 |
| UV-3 | 0.070 |
| Gelatin | 1.30 |
| Fifth layer | |

(Sample 101)

| | | |
|---|---|---|
| (3rd red-sensitive emulsion layer) | | |
| Emulsion E-2 | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.097 |
| ExC-2 | | 0.010 |
| ExC-3 | | 0.065 |
| ExC-6 | | 0.020 |
| HBS-1 | | 0.22 |
| HBS-2 | | 0.10 |
| Gelatin | | 1.63 |
| Sixth layer (Interlayer) | | |
| Cpd-1 | | 0.040 |
| HBS-1 | | 0.020 |
| Gelatin | | 0.80 |
| Seventh layer (1st green-sensitive emulsion layer) | | |
| Emulsion C | silver | 0.30 |
| ExS-4 | | $2.6 \times 10^{-5}$ |
| ExS-5 | | $1.8 \times 10^{-4}$ |
| ExS-6 | | $6.9 \times 10^{-4}$ |
| ExM-1 | | 0.021 |
| ExM-2 | | 0.26 |
| ExM-3 | | 0.030 |
| ExY-1 | | 0.025 |
| HBS-1 | | 0.10 |
| HBS-3 | | 0.010 |
| Gelatin | | 0.63 |
| Eighth layer (2nd green-sensitive emulsion layer) | | |
| Emulsion D | silver | 0.55 |
| ExS-4 | | $2.2 \times 10^{-5}$ |
| ExS-5 | | $1.5 \times 10^{-4}$ |
| ExS-6 | | $5.8 \times 10^{-4}$ |
| ExM-2 | | 0.094 |
| ExM-3 | | 0.026 |
| ExY-1 | | 0.018 |
| HBS-1 | | 0.16 |
| HBS-3 | | $8.0 \times 10^{-3}$ |
| Gelatin | | 0.50 |
| Ninth layer (3rd green-sensitive emulsion layer) | | |
| Emulsion E-1 | silver | 1.55 |
| ExS-4 | | $4.6 - 10^{-5}$ |
| ExS-5 | | $1.0 \times 10^{-4}$ |
| ExS-6 | | $3.9 \times 10^{-4}$ |
| ESC-1 | | 0.015 |
| ExM-1 | | 0.013 |
| ExM-4 | | 0.065 |
| ExM-5 | | 0.019 |
| HBS-1 | | 0.25 |
| HBS-2 | | 0.10 |
| Gelatin | | 1.54 |

(Sample 101)

| | | |
|---|---|---|
| Tenth layer (Yellow filter layer) | | |
| Yellow colloidal silver | silver | 0.035 |
| Cpd-1 | | 0.080 |
| HBS-1 | | 0.030 |
| Gelatin | | 0.95 |
| Eleventh layer (1st blue-sensitive emulsion layer) | | |
| Emulsion C | silver | 0.18 |
| ExS-7 | | $8.6 \times 10^{-4}$ |
| ExY-1 | | 0.042 |
| ExY-2 | | 0.72 |
| HBS-1 | | 0.28 |
| Gelatin | | 1.10 |
| Twelfth layer (2nd blue-sensitive emulsion layer) | | |
| Emulsion D | silver | 0.40 |
| ExS-7 | | $7.4 \times 10^{-4}$ |
| ExC-7 | | $7.0 \times 10^{-3}$ |
| ExY-2 | | 0.15 |
| HBS-1 | | 0.050 |
| Gelatin | | 0.78 |
| Thirteenth layer (3rd blue-sensitive emulsion layer) | | |
| Emulsion F | silver | 0.70 |
| ExS-7 | | $2.8 \times 10^{-4}$ |
| ExY-2 | | 0.20 |
| HBS-1 | | 0.070 |
| Gelatin | | 0.69 |
| Fourteenth layer (1st protective layer) | | |
| Emulsion G | silver | 0.20 |
| U-4 | | 0.11 |
| U-5 | | 0.17 |
| HBS-1 | | $5.0 \times 10^{-2}$ |
| Gelatin | | 1.00 |
| Fifteenth layer (2nd protective layer) | | |
| H-1 | | 0.40 |
| B-1 (diameter = 1.7 μm) | | $5.0 \times 10^{-2}$ |
| B-2 (diameter = 1.7 μm) | | 0.10 |
| B-3 | | 0.10 |
| S-1 | | 0.20 |
| Gelatin | | 1.20 |

In addition, in order to improve storage stability, processability, resistance to pressure, antiseptic and mildewproofing properties, antistatic properties, and coating properties, W-1, W-2, W-3, B-4, F-1, F-2, F-3, F-4, F-5, F-6, F-7, F-8, F-9, F-10, F-11, F-12, F-13, F-14, F-15, F-16, F-17, and iron salt, lead salt, gold salt, platinum salt, iridium salt, and rhodium salt were added to all of the above layers.

TABLE 4

| | Average AgI content (%) | Average grain size (μm) | Variation coefficient (%) according to grain size | Diameter/ thickness ratio | Silver content ratio [core/intermediate/ shell] (AgI content) | Grain structure/ shape |
|---|---|---|---|---|---|---|
| Emulsion A | 4.0 | 0.45 | 27 | 1 | (1/3) (13/1) | Double-structure octahedral grain |
| Emulsion B | 8.9 | 0.70 | 14 | 1 | (3/7) (25/2) | Double-structure octahedral grain |
| Emulsion C | 2.0 | 0.55 | 25 | 7 | — | Uniform-structure tabular grain |
| Emulsion D | 9.0 | 0.65 | 25 | 6 | (12/59/29) (0/11/8) | Triple-structure tabular grain |

TABLE 4-continued

| | Average AgI content (%) | Average grain size (μm) | Variation coefficient (%) according to grain size | Diameter/ thickness ratio | Silver content ratio [core/intermediate/ shell] (AgI content) | Grain structure/ shape |
|---|---|---|---|---|---|---|
| Emulsion F | 14.5 | 1.25 | 25 | 3 | (37/63) (34/3) | Double-structure tabular grain |
| Emulsion G | 1.0 | 0.07 | 15 | 1 | — | Uniform-structure fine grain |

In Table 4:

(1) The emulsions A to D, E-1, E-2, and F were subjected to reduction sensitization during grain preparation by using thiourea dioxide and thiosulfonic acid in accordance with the embodiments in JP-A-2-191938.

(2) The emulsions A to D, E-1, E-2, and F were subjected to gold sensitization, sulfur sensitization, and selenium sensitization in the presence of spectral sensitizing dyes and sodium thiocyanate described for respective layers in accordance with the embodiments in Japanese Patent Application No. 2-34090.

(3) Low-molecular weight gelatin was used in preparation of tabular grains in accordance with the examples in JP-A-1-158426.

ExC-1

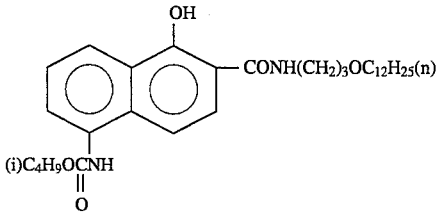

ExC-2

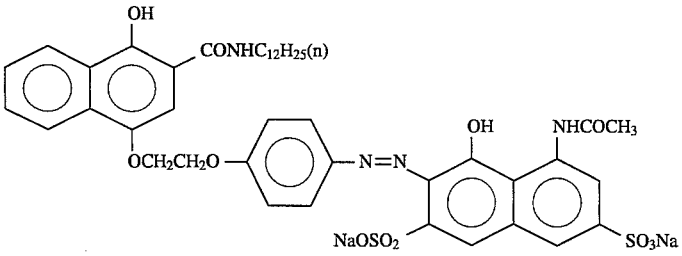

ExC-3

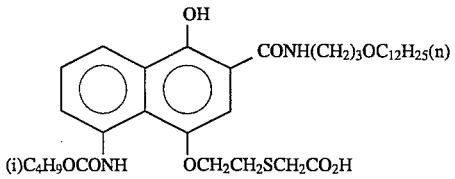

ExC-4

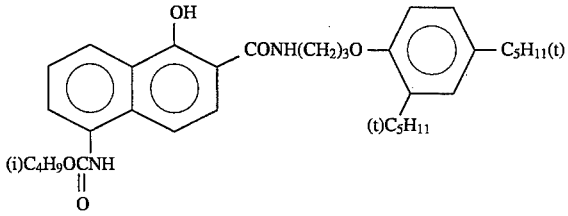

-continued
ExC-5
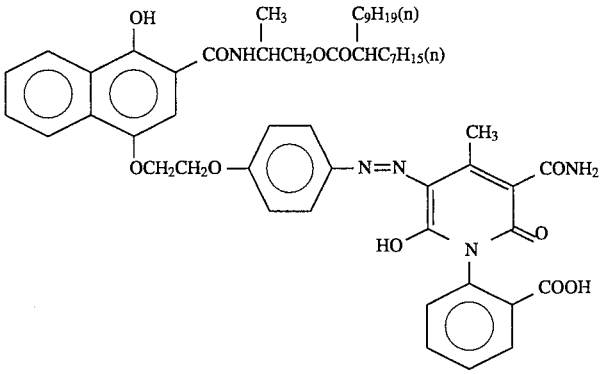
ExC-6
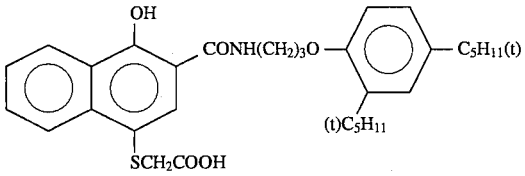
ExC-7
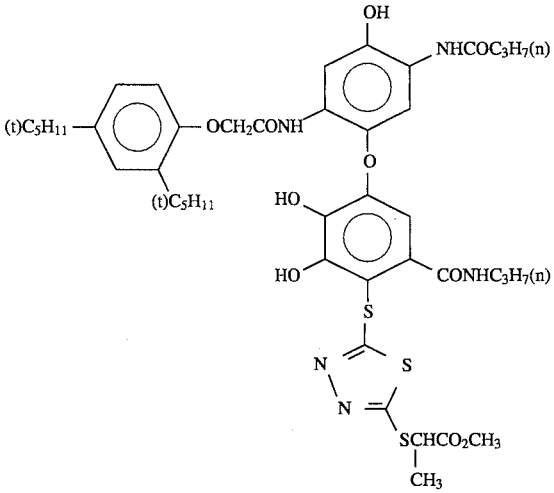
ExM-1
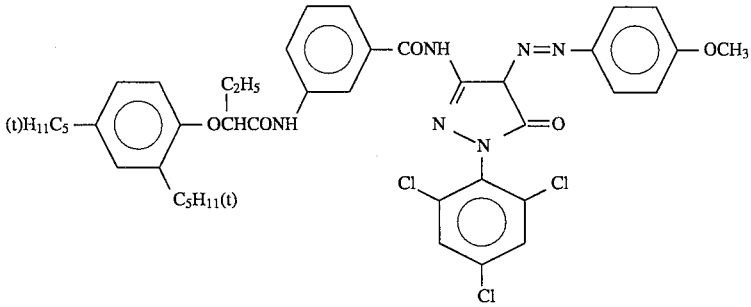

-continued
ExM-2
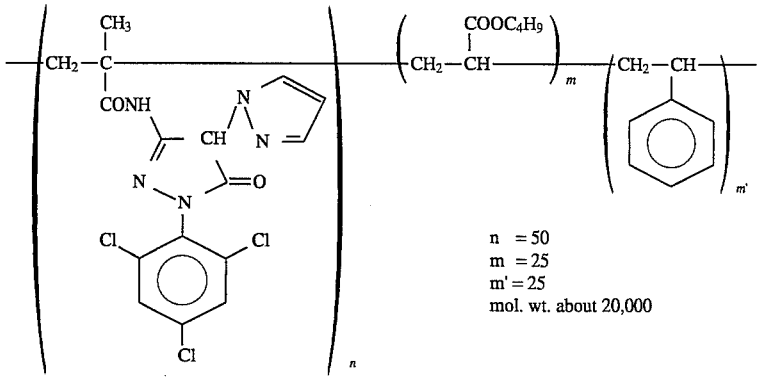
n = 50
m = 25
m' = 25
mol. wt. about 20,000
ExM-3
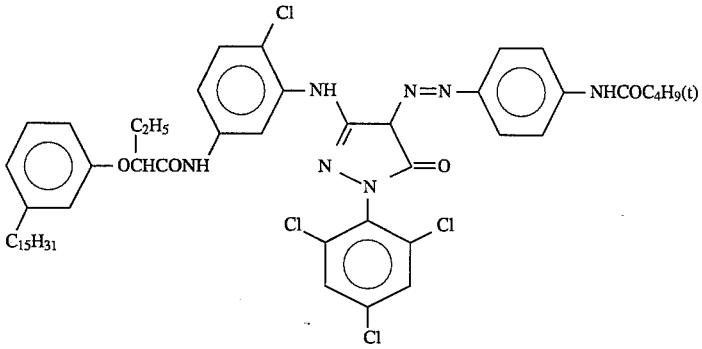
ExM-4
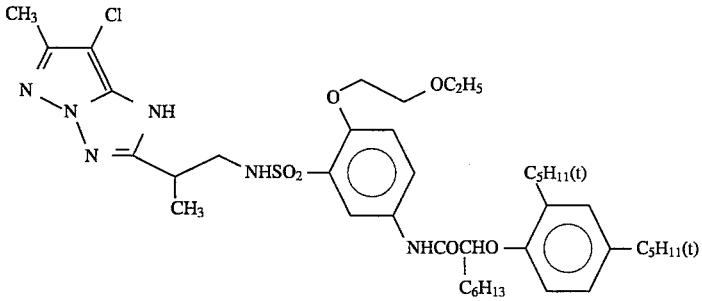
ExM-5
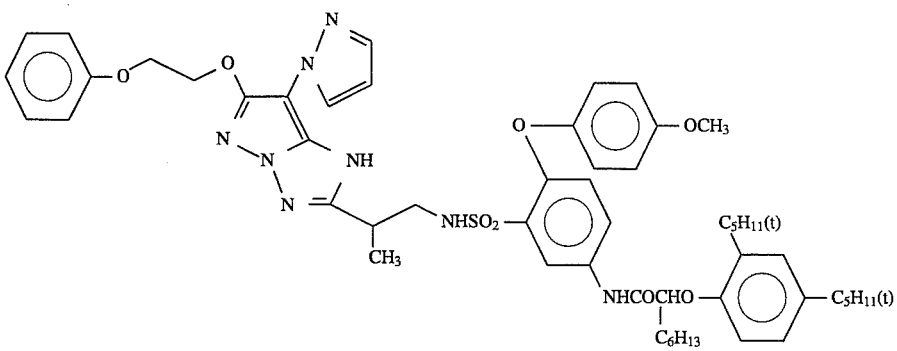

-continued
ExY-1
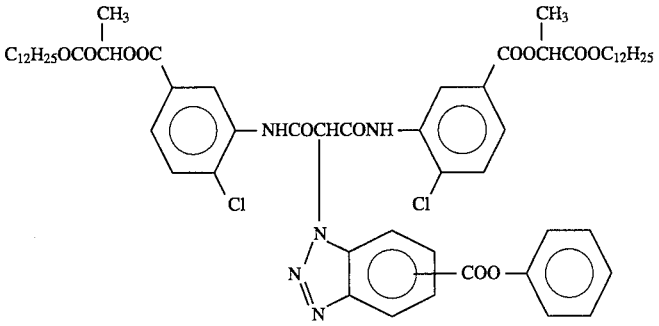
ExY-2
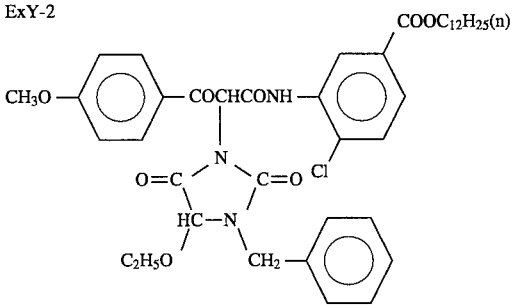
ExF-1
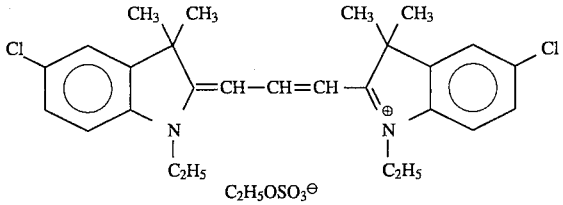
Cpd-1
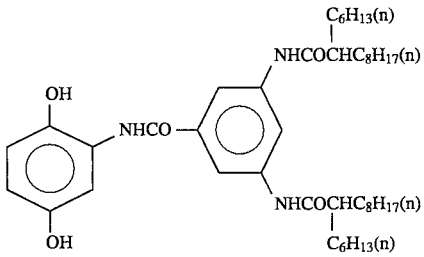
UV-1
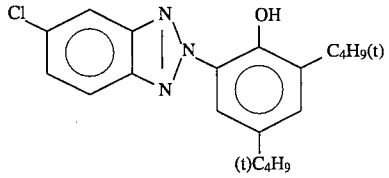
UV-2
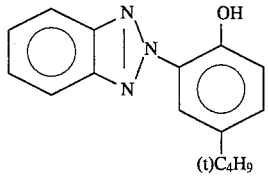

-continued
UV-3
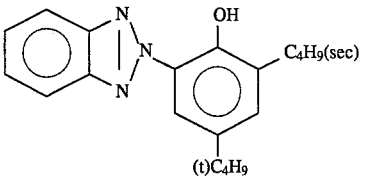
UV-4
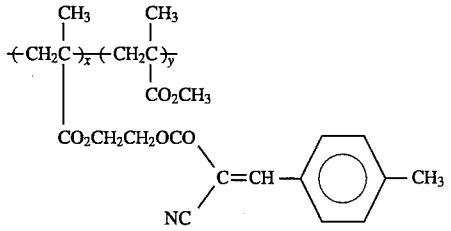
x:y = 70:30 (wt %)
UV-5
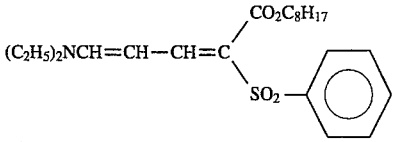
HBS-1 Tricresylphosphate
HBS-2 Di-n-butylphthalate
HBS-3
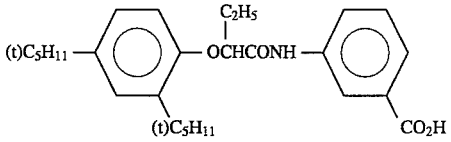
ExS-1
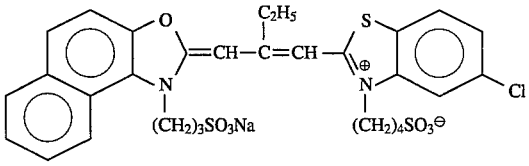
ExS-2
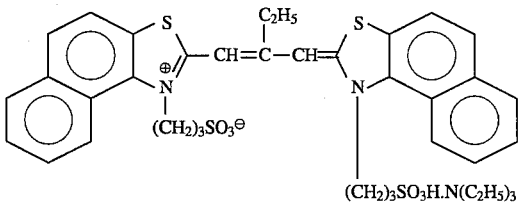
ExS-3
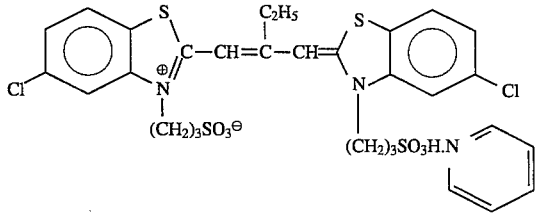

-continued
ExS-4
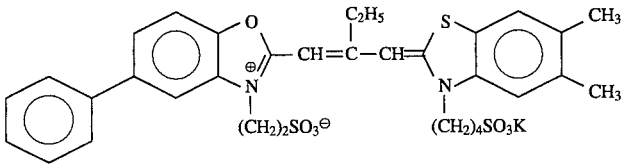
ExS-5
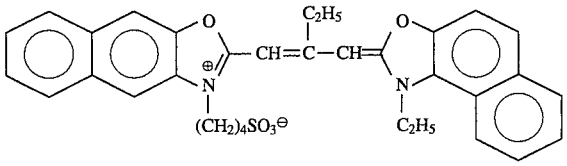
ExS-6
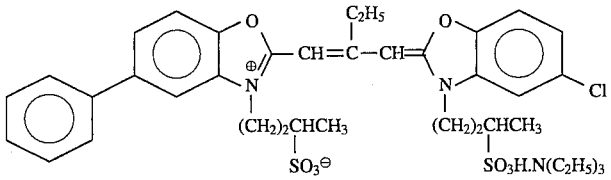
ExS-7
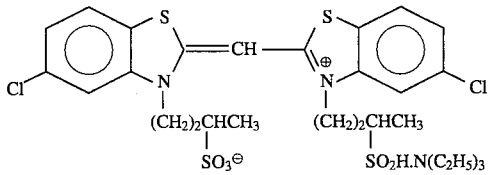
S-1
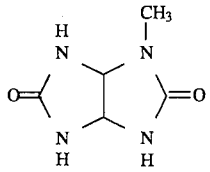
H-1
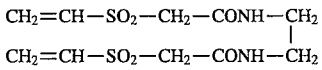
B-1
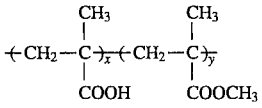
x/y = 10/90
B-2
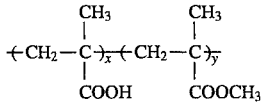
x/y = 40/60
B-3
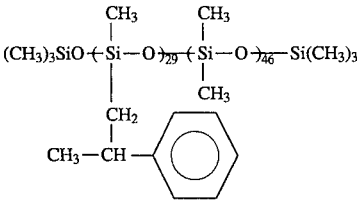
B-4
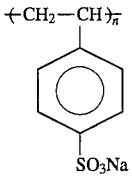
B-5
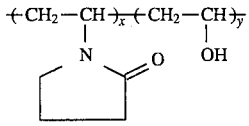
x/y = 70/30
B-6
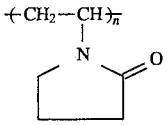
(mol. wt. about 10,000)

-continued

W-1

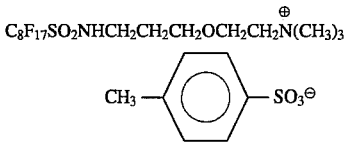

W-2

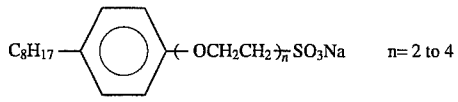

n= 2 to 4

W-3

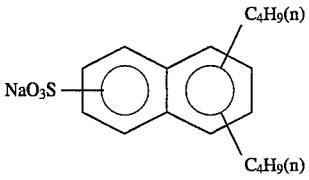

F-1

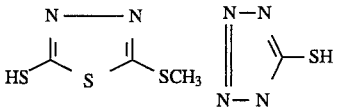

F-2

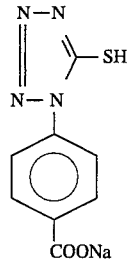

F-3

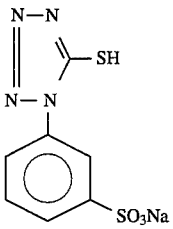

F-4

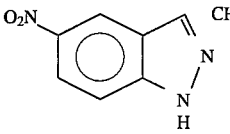

F-5

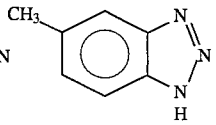

F-6

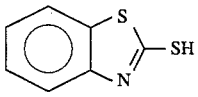

F-7

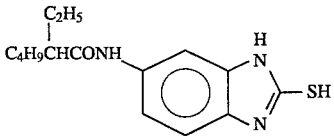

F-8

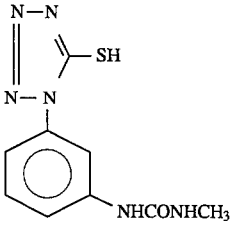

F-9

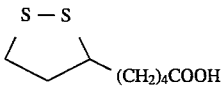

F-10

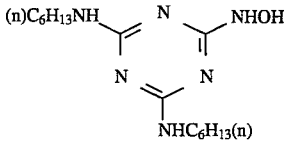

F-11

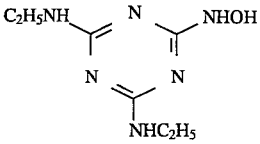

F-12

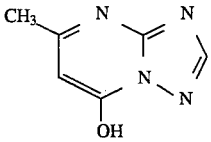

F-11

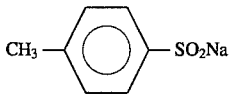

F-14

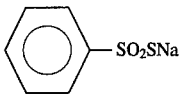

F-15

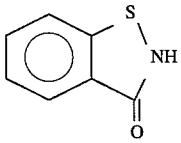

F-16

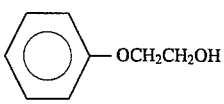

F-17

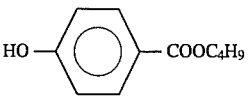

(Sample 102)

A sample 102 was manufactured following the same procedures as for the sample 101 except that ExS-5 in the seventh, eighth, and ninth layers was replaced with an equal molar quantity of a compound A-11 described previously.

(Sample 103)

A sample 103 was manufactured following the same procedures as for the sample 102 except that the emulsion E-1 in the ninth layer was replaced with an equal amount of the emulsion E-2.

(Sample 104)

A sample 104 was manufactured following the same procedures as for the sample 101 except that ExS-5 in the seventh, eighth, and ninth layers was replaced with an equal molar quantity of the compound B-11 described previously.

(Sample 105)

A sample 105 was manufactured following the same procedures as for the sample 102 except that B-5 in the first layer was replaced with an equal amount of B-6.

(Sample 106)

A sample 106 was manufactured following the same procedures as for the sample 102 except that B-5 in the first layer was removed.

Evaluation of pressure characteristics was performed as follows. That is, each coated sample was fixed at its one end such that its emulsion surface faced inward under a humidity-controlled condition at a relative humidity of 40%. The fixed sample was bent through 180° at a bending speed of 360°/sec along a stainless steel pipe having a diameter of 10 mm. This bending was performed 10 seconds before exposure.

These samples were subjected to sensitometry exposure at a color temperature of 4,800° K. through a continuous wedge for 1/100 sec., and processed by the following method.

| | (Processing method) | |
|---|---|---|
| Process | Time | Temperature |
| Color development | 3 min. 15 sec. | 38° C. |
| Bleaching | 6 min. 30 sec. | 38° C. |
| Washing | 2 min. 10 sec. | 24° C. |
| Fixing | 4 min. 20 sec. | 38° C. |
| Washing (1) | 1 min. 05 sec. | 24° C. |
| Washing (2) | 1 min. 00 sec. | 24° C. |
| Stabilization | 1 min. 05 sec. | 38° C. |
| Drying | 4 min. 20 sec. | 55° C. |

The compositions of the processing solutions will be presented below.

| | (unit: g) |
|---|---|
| Color developing solution: | |
| Diethylenetriaminepentaacetate | 1.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxylethylamino)-2-methylaniline sulfate | 4.5 |
| Water to make | 1.0 1 |

-continued

| | (unit: g) |
|---|---|
| pH | 10.05 |
| Bleaching solution: | |
| Ferric Sodium ethylenediamine-tetraacetate trihydrate | 100.0 |
| Disodium ethylenediaminetetraacetate | 10.0 |
| Ammonium bromide | 140.0 |
| Ammonium nitrate | 30.0 |
| Ammonia water (27%) | 6.5 ml |
| Water to make | 1.0 1 |
| pH | 6.0 |
| Fixing solution: | |
| Disodium ethylenediaminetetraacetate | 0.5 |
| Sodium sulfite | 7.0 |
| Sodium bisulfite | 5.0 |
| Ammonium thiosulfate aqueous solution (70%) | 170.0 ml |
| Water to make | 1.0 1 |
| pH | 6.7 |
| Stabilizing solution: | |
| Formalin (37%) | 2.0 ml |
| Polyoxyethylene-p-monononylphenylether (average polymerization degree = 10) | 0.3 |
| Disodium ethylenediaminetetraacetate | 0.05 |
| Water to make | 1.0 1 |
| pH | 5.0–8.0 |

The densities of the processed samples were measured through a green filter.

The obtained sensitivity and fog were evaluated for each of the bent and non-bent portions. The sensitivity is represented by a relative value of a reciprocal of an exposure quantity required to obtain an optical density higher by 0.15 than fog. The obtained results are summarized in Table 5.

TABLE 5

| Sample No. | Tabular grain in 9th layer | Naphthoxazole dye in 7th, 8th, and 9th layers | Compound in 1st layer | Non-bent portion Sensitivity | Non-bent portion Fog | Bent portion Sensitivity | Bent portion Fog | Remaining silver content (μg/m²) |
|---|---|---|---|---|---|---|---|---|
| 101 (Comparative Example) | E-1 | ExS-5 | B-5 | 100 (reference) | 0.09 | 92 | 0.15 | 2.0 |
| 102 (Present Invention) | E-1 | A-11 | B-5 | 108 | 0.08 | 107 | 0.09 | 1.2 |
| 103 (Comparative Example) | E-2 | A-11 | B-5 | 98 | 0.08 | 75 | 0.25 | 1.4 |
| 104 (Present Invention) | E-1 | B-11 | B-5 | 107 | 0.08 | 104 | 0.10 | 1.1 |
| 105 (Present Invention) | E-1 | A-11 | B-6 | 108 | 0.08 | 107 | 0.09 | 1.0 or less |
| 106 (Comparative Example) | E-1 | A-11 | — | 110 | 0.09 | 102 | 0.14 | 8.7 |

Sensitivity is represented by a relative value assuming that the sensitivity in a non-bent portion of the sample 101 is 100.

In addition, the above processing was performed for samples uniformed exposed with an exposure quantity for yielding a density higher by 2 than a fog density, and the remaining silver amount was measured. The results are also shown in Table 5.

As is apparent from Table 5, each of the samples 102, 104, and 105 of the present invention has a high sensitivity, a high resistance to pressure, and a good desilvering property, thus indicating the remarkable effect of the present invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A silver halide photographic light-sensitive material having at least one silver halide emulsion layer on a support, wherein not less than 50% of a total projected area of silver halide grains of at least one silver halide emulsion contained in said silver halide emulsion layer are accounted for by tabular silver halide grains each having an aspect ratio of not less than and each containing dislocations, at least one layer of said light-sensitive material contains at least one sensitizing dye represented by Formula (A), (B) or (C) below, and at least one layer of said light-sensitive material contains a polymer having a repeating unit represented by Formula (II) below:

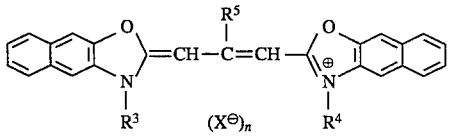

Formula (A)

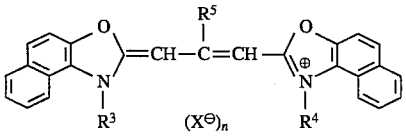

Formula (B)

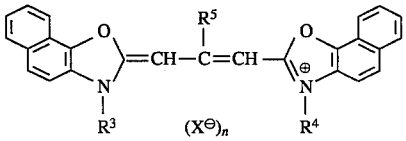

Formula (C)

wherein each of $R^3$ and $R^4$ represents an alkyl group, $R^5$ represents a hydrogen atom, an alkyl group, or an aryl group, X represents an anion, n represents a value for adjusting an electric charge of a whole molecule, and when an inner salt is to be formed, n=0:

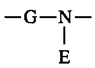

Formula (II)

wherein E represents $—COR_{21}$, $—COOR_{22}$, $—CONHR_{23}$, $—CONHCOR_{24}$, or $—SO_2R_{25}$, wherein each of $R_{21}$, $R_{22}$, $R_{23}$, $R_{24}$, and $R_{25}$ represents a substituted or unsubstituted alkyl, aryl, or cycloalkyl group, or a hydrogen atom, and G represents an alkylene group having 2 to 5 carbon atoms.

2. The light-sensitive material according to claim 1, wherein said $R^5$ is ethyl.

3. The light-sensitive material according to claim 1, wherein said polymer having a repeating unit of formula (II) is contained in a non-light sensitive layer.

4. The light-sensitive material according to claim 3, wherein said polymer having a repeating unit of Formula (II) is contained in an amount of 1 to 1,000 g per mol of silver halide.

5. The light-sensitive material according to claim 3, wherein said polymer having a repeating unit of Formula (II) is contained in an amount of 10 to 500 g per mol of silver halide.

6. The light-sensitive material according to claim 1, wherein said tabular silver halide grains occupy at least 80% of said total projected area.

7. The light-sensitive material according to claim 1, wherein an average aspect ratio of said tabular silver halide grains is from 3 to less than 8.

8. The light-sensitive material according to claim 1, wherein said dislocations each extends from a position away from the center of the long axis of the grain by a distance corresponding to 10% to less than 100% of the length between said center and an edge of the grain, and said dislocations reach said edge.

9. The light-sensitive material according to claim 1, wherein said dislocations each extends from a position away from the center of the long axis of the grain by a distance corresponding to 30% to less than 98% of the length between said center and an edge of the grain, and said dislocations reach said edge.

10. The light-sensitive material according to claim 1, wherein said dislocations each extends from a position away from the center of the long axis of the grain by a distance corresponding to 50% to less than 95% of the length between said center and an edge of the grain, and said dislocations reach said edge.

11. The light-sensitive material according to claim 1, wherein 50% in number or more of said tabular grains have 10 or more dislocations.

12. The light-sensitive material according to claim 1, wherein 80% in number or more of said tabular grains have 10 or more dislocations.

13. The light-sensitive material according to claim 1, wherein 80% in number or more of said tabular grains have 20 or more dislocations.

14. The light-sensitive material according to claim 1, wherein said silver halide emulsion comprises silver bromoiodide or silver bromochloroiodide grains containing 30 mol % or less of silver iodide.

15. The light-sensitive material according to claim 1, wherein said tabular grains each comprises an iodide-rich phase for introduction of said dislocations, said iodide-rich phase containing silver halide in an amount, in terms of silver, of 10 mol % or less of the silver content of a whole grain.

16. The light-sensitive material according to claim 1, wherein said sensitizing dye is contained in an amount of $4\times10^{-6}$ to $8\times10^{-3}$mol per mol of silver halide.

* * * * *